US011270837B2

(12) United States Patent
Kim et al.

(10) Patent No.: US 11,270,837 B2
(45) Date of Patent: Mar. 8, 2022

(54) POWER INDUCTOR

(71) Applicant: MODA-INNOCHIPS CO., LTD., Ansan-Si (KR)

(72) Inventors: Gyeong Tae Kim, Ansan-Si (KR); Ki Joung Nam, Siheung-Si (KR); Tae Geun Seo, Osan-Si (KR)

(73) Assignee: MODA-INNOCHIPS CO., LTD.

( * ) Notice: Subject to any disclaimer, the term of this patent is extended or adjusted under 35 U.S.C. 154(b) by 502 days.

(21) Appl. No.: 16/326,186

(22) PCT Filed: Sep. 27, 2017

(86) PCT No.: PCT/KR2017/010672

§ 371 (c)(1),
(2) Date: Feb. 15, 2019

(87) PCT Pub. No.: WO2018/062825

PCT Pub. Date: Apr. 5, 2018

(65) Prior Publication Data

US 2019/0189340 A1 Jun. 20, 2019

(30) Foreign Application Priority Data

Sep. 30, 2016 (KR) ..... 10-2016-0126741

(51) Int. Cl.
*H01F 3/08* (2006.01)
*H01F 27/32* (2006.01)
(Continued)

(52) U.S. Cl.
CPC ..... *H01F 27/323* (2013.01); *H01F 3/08* (2013.01); *H01F 3/10* (2013.01); *H01F 17/0013* (2013.01);
(Continued)

(58) Field of Classification Search
CPC ..... H01F 17/0013; H01F 2027/2809; H01F 17/0006; H01F 27/2804; H01F 5/003;
(Continued)

(56) References Cited

U.S. PATENT DOCUMENTS

2012/0188049 A1 7/2012 Matsuura et al.
2014/0167897 A1* 6/2014 Choi ..... H01F 41/0246 336/83
(Continued)

FOREIGN PATENT DOCUMENTS

CN 105225802 A 1/2016
CN 105869833 A 8/2016
(Continued)

OTHER PUBLICATIONS

Written Opinion for PCT/KR2017/010672 dated Jan. 15, 2018.
(Continued)

*Primary Examiner* — Tszfung J Chan
(74) *Attorney, Agent, or Firm* — Renaissance IP Law Group LLP

(57) ABSTRACT

Provided is a power inductor. The power inductor includes a body including magnetic powder and a polymer, at least one base provided in the body and having at least one surface on which at least one coil pattern is disposed, and an insulation layer disposed between the coil pattern and the body. The body includes at least region in which the magnetic powder having a particle size different from that of the magnetic power in a remaining region is distributed.

11 Claims, 20 Drawing Sheets

(51) Int. Cl.

| | |
|---|---|
| ***H01F 17/00*** | (2006.01) |
| ***H01F 27/28*** | (2006.01) |
| ***H01F 3/10*** | (2006.01) |
| *H01F 17/04* | (2006.01) |
| *H01F 27/02* | (2006.01) |

(52) U.S. Cl.
CPC ..... *H01F 27/2804* (2013.01); *H01F 27/022* (2013.01); *H01F 2003/106* (2013.01); *H01F 2017/048* (2013.01); *H01F 2027/2809* (2013.01)

(58) Field of Classification Search
CPC ..... H01F 27/245; H01F 27/255; H01F 27/29; H01F 27/292; H01F 27/323; H01F 2003/106
USPC ..... 336/200, 232
See application file for complete search history.

(56) References Cited

U.S. PATENT DOCUMENTS

| | | | | |
|---|---|---|---|---|
| 2015/0270056 | A1 | 9/2015 | Okada | |
| 2015/0371752 | A1* | 12/2015 | Park | H01F 27/292 336/200 |
| 2016/0042859 | A1 | 2/2016 | Park et al. | |
| 2016/0180995 | A1* | 6/2016 | Park | H01F 17/0013 336/233 |
| 2016/0225512 | A1 | 8/2016 | Kim | |
| 2016/0234979 | A1* | 8/2016 | Lee | H05K 9/0026 |
| 2016/0240296 | A1* | 8/2016 | Kim | H01F 17/04 |

FOREIGN PATENT DOCUMENTS

| | | | | | |
|---|---|---|---|---|---|
| JP | 2007049142 | A | | 2/2007 | |
| JP | 2014130988 | A | | 7/2014 | |
| JP | 2015142074 | A | | 8/2015 | |
| JP | 2016021510 | A | | 2/2016 | |
| JP | 2016092404 | A | * | 5/2016 | H01F 17/0013 |
| JP | 2016092404 | A | | 5/2016 | |
| KR | 20070032259 | A | | 3/2007 | |
| KR | 20130109048 | A | | 10/2013 | |
| KR | 20140077346 | A | | 6/2014 | |
| KR | 20140085997 | A | | 7/2014 | |
| KR | 101580406 | B1 | | 12/2015 | |
| KR | 20160018382 | A | | 2/2016 | |
| KR | 101607026 | B1 | | 3/2016 | |
| KR | 20160098780 | A | | 8/2016 | |

OTHER PUBLICATIONS

Extended European Search Report for Application No. 17856711.1 dated Apr. 29, 2020.
International Search Report for PCT/KR2017/010672 dated Jan. 15, 2018.

* cited by examiner (a)

(b)

(a)

(b)

(a)

(b)

(a)

(b)

POWER INDUCTOR

TECHNICAL FIELD

The present disclosure relates a power inductor, and more particularly, to a power inductor having superior inductance properties and improved insulation.

BACKGROUND

A power inductor is mainly provided in a power circuit such as a DC-DC converter within a portable device. The power inductor is increasing in use instead of an existing wire wound choke coil as the power circuit is switched at a high frequency and is miniaturized. Also, the power inductor is being developed in the manner of miniaturization, high current, low resistance, and the like as the portable device is reduced in size and multi-functionalized.

The power inductor according to the related art is manufactured in a shape in which a plurality of ferrites or ceramic sheets made of a dielectric having a low dielectric constant are laminated. Here, a coil pattern is formed on each of the ceramic sheets, and thus, the coil pattern formed on each of the ceramic sheets is connected to the ceramic sheet by a conductive via, and the coil patterns overlap each other in a vertical direction in which the sheets are laminated. Also, in the related art, the body in which the ceramic sheets are laminated may be generally manufactured by using a magnetic material composed of a four element system of nickel (Ni), zinc (Zn), copper (Cu), and iron (Fe).

However, the magnetic material has a relatively low saturation magnetization value when compared to that of the metal material, and thus, the magnetic material may not realize high current properties that are required for the recent portable devices. As a result, since the body constituting the power inductor is manufactured by using magnetic powder, the power inductor may relatively increase in saturation magnetization value when compared to the body manufactured by using the magnetic material. However, if the body is manufactured by using the metal, an eddy current loss and a hysteresis loss at a high frequency wave may increase to cause serious damage of the material.

To reduce the loss of the material, a structure in which the magnetic powder is insulated from each other by a polymer may be applied. That is, sheets in which the magnetic powder and the polymer are mixed with each other are laminated to manufacture the body of the power inductor. Also, a predetermined base on which a coil pattern is formed is provided inside the body. That is, the coil pattern is formed on the predetermined base, and a plurality of sheets are laminated and compressed on upper and lower sides of the coil pattern to manufacture the power inductor. Also, an insulation layer is disposed on the coil pattern to insulate the coil pattern from the magnetic powder.

The coil inductance may be proportional to magnetic permeability. Thus, to realize high inductance in unit volume, a material having high magnetic permeability may be required. Since magnetic permeability in the magnetic powder increases according to an increase in size of a particle, a particle having a large size may be used to realize the high magnetic permeability. However, the magnetic powder having a large size may cause insulation breakdown to deteriorate inductance. That is, the magnetic powder having the large size may pass through the insulation layer disposed on the coil pattern to come into contact with the coil pattern, thereby causing the insulation breakdown. Thus, the inductance of the coil may be deteriorated. Also, when the magnetic powder increases in size, a polymer may be reduced in content. As a result, as the polymer is reduced in content, specific resistance may be reduced. Thus, there is a limitation that it is difficult to control a shape of an external electrode disposed on a surface of a body. As a result, the external electrode may be delaminated or peeled.

PRIOR ART DOCUMENTS

Korean Patent Publication No. 2007-0032259

DISCLOSURE OF THE INVENTION

Technical Problem

The present disclosure provides a power inductor that is capable of improving insulation between a coil pattern and a body and preventing insulation breakdown from occurring.

The present disclosure also provides a power inductor that is capable of easily controlling a shape of an external electrode.

Technical Solution

In accordance with an exemplary embodiment, a powder inductor includes: a body including magnetic powder and a polymer; at least one base provided in the body and having at least one surface on which at least one coil pattern is disposed; and an insulation layer disposed between the coil pattern and the body, wherein the body includes at least region in which the magnetic powder having a particle size different from that of the magnetic powder in a remaining region is distributed.

The magnetic powder in the body may include at least three magnetic powder having different mean values of the particle sizes or different middle values (D50) of grain-size distribution.

The magnetic powder may include first magnetic powder, second magnetic powder having a size less than or equal to that of the first magnetic powder, and third magnetic powder having a size less than or equal to that of the second magnetic powder.

The body may include a first thickness region which comes into contact with the insulation layer and includes the third magnetic powder.

The body may include a second thickness region which is defined inward from at least one of top and bottom surfaces of the base in a vertical direction and includes the third magnetic powder.

The body may have a remaining region including the first to third magnetic powder.

At least one of the first to third magnetic powder may further include at least one magnetic powder having a different middle value of the grain-size distribution.

The power inductor may further include fourth magnetic powder having a composition different from that of each of the first to third magnetic powder.

At least one of the first to fourth magnetic powder may be crystalline.

In the body, the second thickness region may have a polymer content greater than that of the other region.

The power inductor may further include a capping insulation layer disposed on at least one surface of the body.

In accordance with another exemplary embodiment, a power inductor includes: a body including magnetic powder and a polymer; at least one base provided in the body and having at least one surface on which at least one coil pattern is disposed; an external electrode connected to the coil pattern and disposed outside the body; and an insulation layer disposed between the coil pattern and the body, wherein the body has at least one surface having specific resistance different from that of the other surface.

A surface of a side of the body, which is mounted on a printed circuit board, may have specific resistance that is greater than that of the other surface.

The magnetic powder may include first magnetic powder, second magnetic powder having a size less than or equal to that of the first magnetic powder, and third magnetic powder having a size less than or equal to that of the second magnetic powder.

The body may include a first thickness region which comes into contact with the insulation layer and includes the third magnetic powder.

The body may include a second thickness region which is defined inward from at least one of top and bottom surfaces of the base in a vertical direction and includes the third magnetic powder.

Advantageous Effects

In the power inductor in accordance with the exemplary embodiments, the body may include the magnetic powder and the polymer, and the first thickness of the body disposed adjacent to the coil pattern may be formed by containing the magnetic powder having the lowest mean grain-size distribution. Thus, the insulation breakdown of the insulation layer disposed on the coil pattern may be prevented to prevent the inductance from being deteriorated.

Also, the predetermined second thickness from the uppermost and lowermost surfaces of the body may be formed by containing the magnetic powder having the lowest men grain-size distribution to increase the content of the polymer. Thus, the specific resistance on the surface of the body may increase, and thus, the delamination or peeling of the external electrode may be prevented to easily control the shape of the external electrode.

Also, the rest thickness between the first and second thicknesses may be formed by containing at least two magnetic powder having different mean grain-size distribution. Therefore, the magnetic permeability may be adjusted according to the size of the magnetic powder.

The thermal conductive filler may be further provided in the body to well release the heat of the body to the outside, thereby preventing the inductance from being deteriorated by the heating of the body. In addition, the insulation layer may be formed with a thin and uniform thickness on the coil pattern by using the parylene to improve the insulation between the body and the coil and reduce the deterioration in magnetic permeability due to the insulation layer.

MODE FOR CARRYING OUT THE INVENTION

Hereinafter, specific embodiments will be described in detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art.

Figure 1:
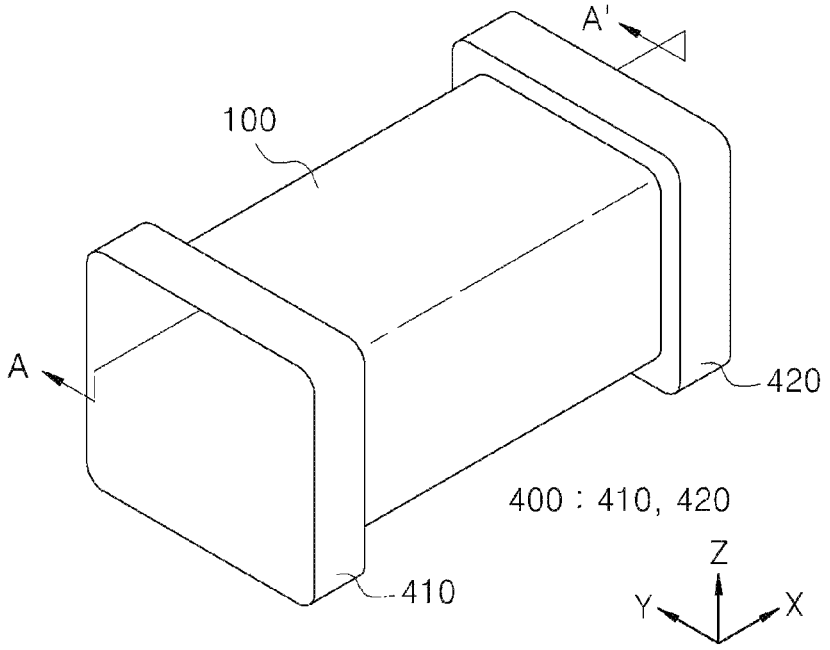
FIG. 1 is a combined perspective view of a power inductor in accordance with an exemplary embodiment.
Figure 2:
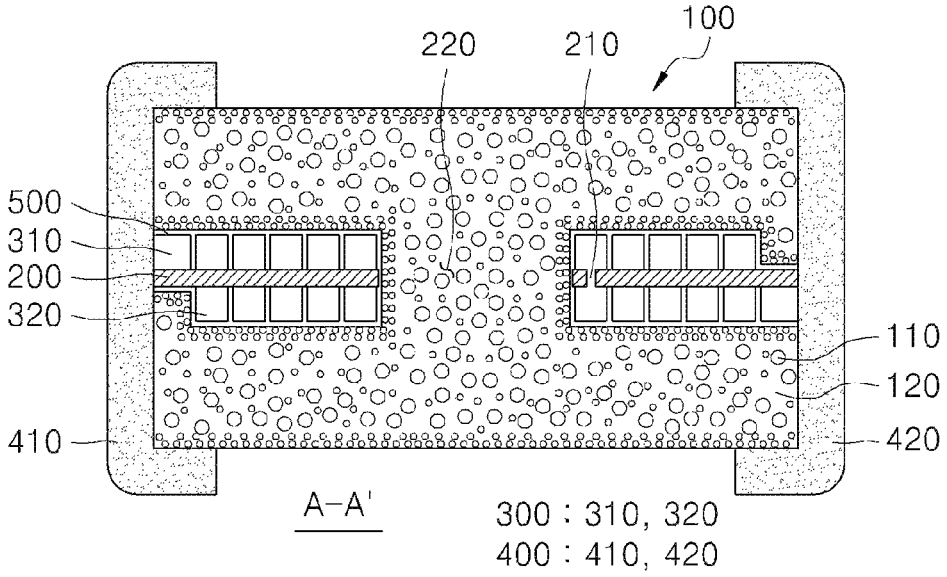
FIG. 2 is a cross-sectional view taken along line A-A' of FIG. 1.
Figure 3:
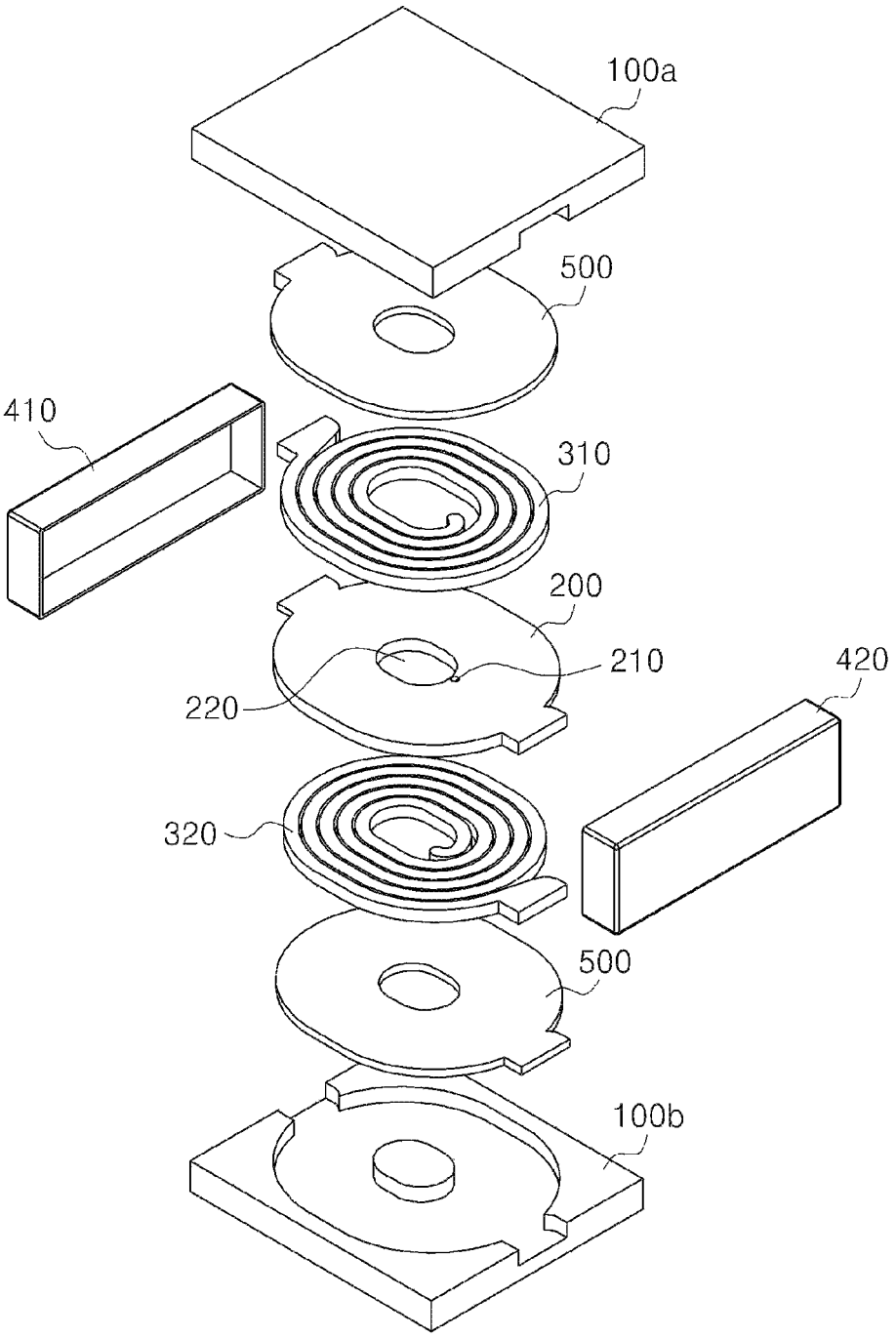
FIGS. 3 and 4 are an exploded perspective view and a partial plan view of the power inductor in accordance with an exemplary embodiment.
Figure 4:
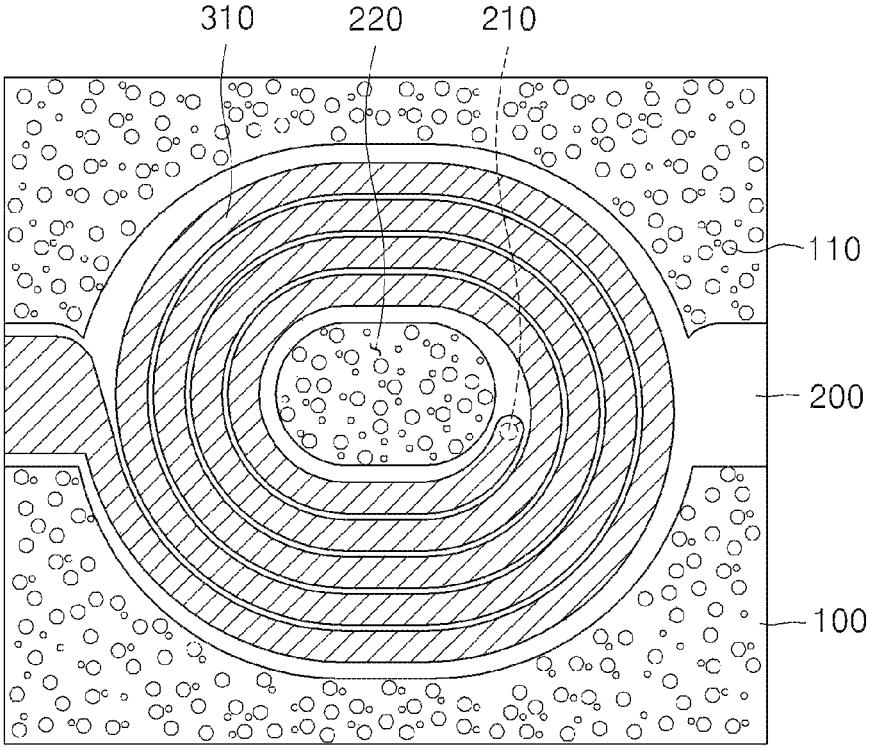
Figure 8:
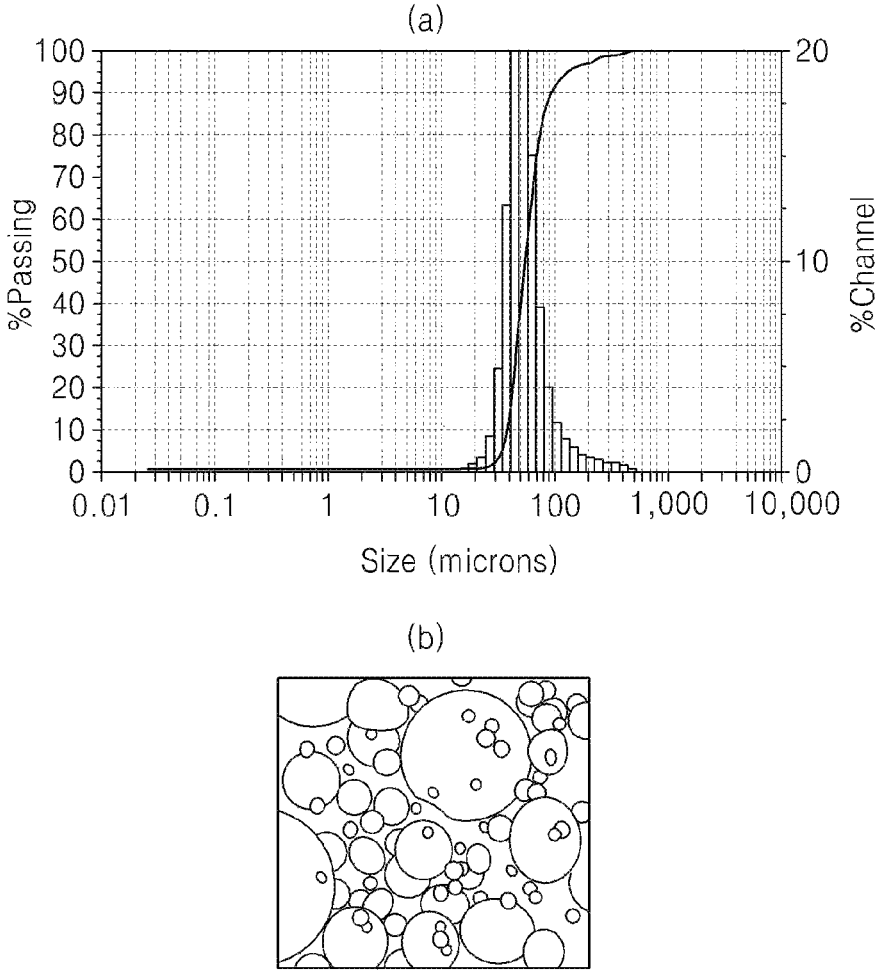
Figure 9:
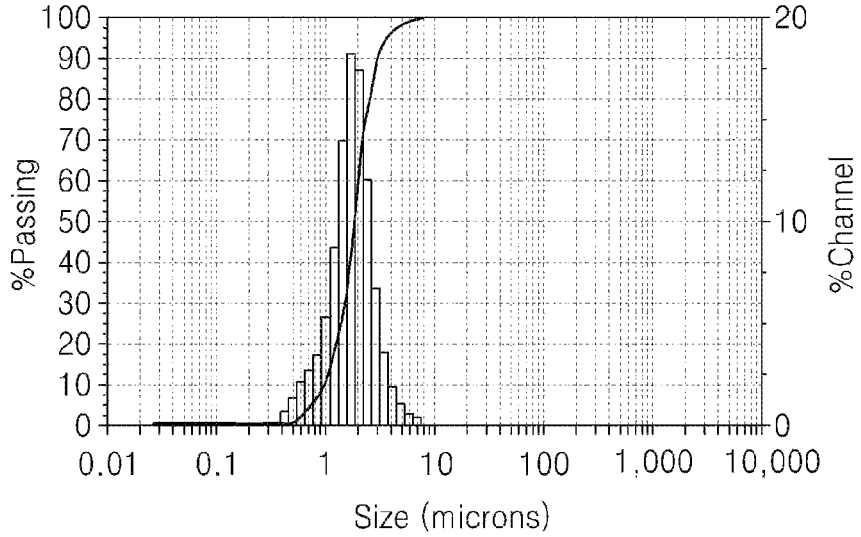
Figure 9:
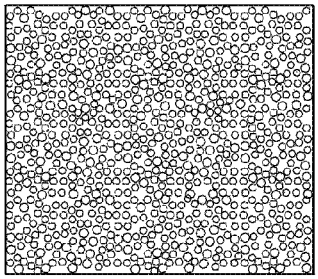
Figure 10:
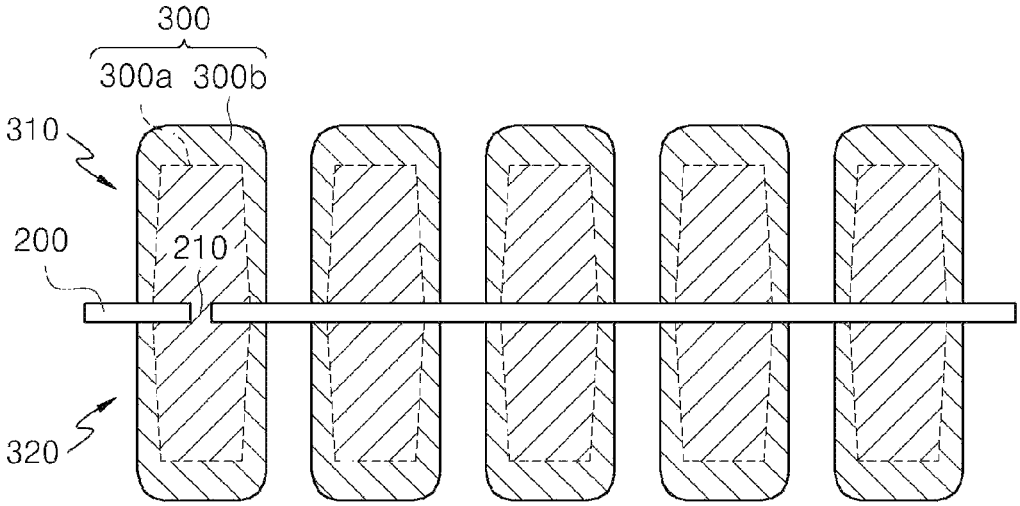
FIGS. 10 and 11 are cross-sectional views for explaining a shape of a coil pattern.
Figure 11:
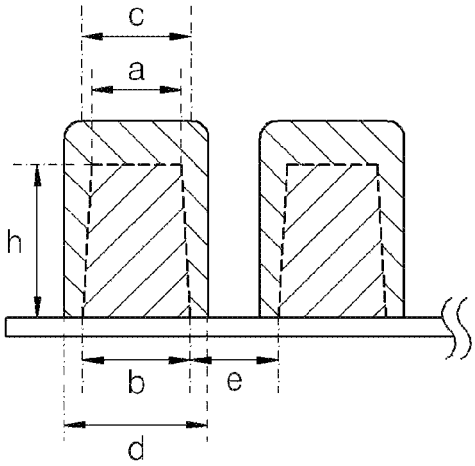
Figure 12:
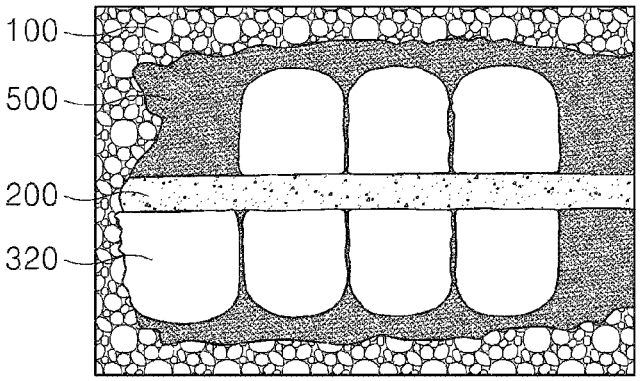
FIGS. 12 and 13 are cross-sectional photographs of the power inductor depending on materials of an insulation layer.
Figure 13:
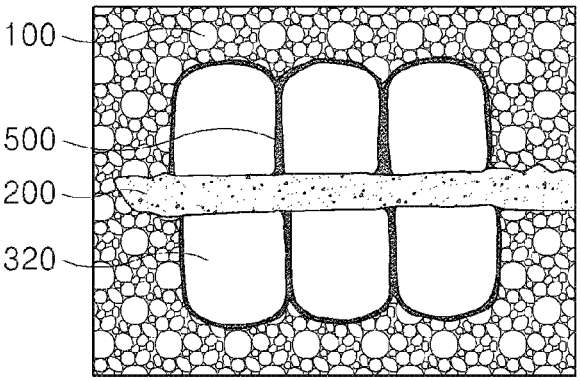
Figure 14:
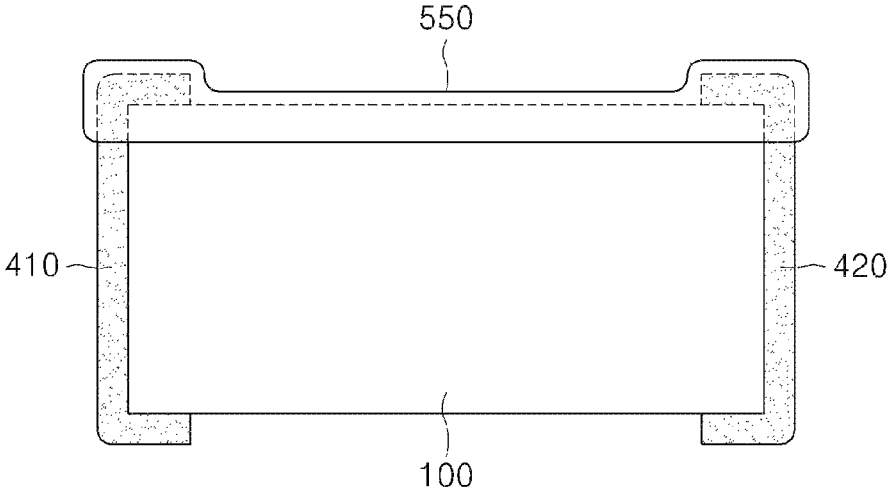
FIG. 14 is a side view illustrating a modified example of the power inductor in accordance with another exemplary embodiment.

FIG. 1 is a combined perspective view of a power inductor in accordance with an exemplary embodiment, and FIG. 2 is a cross-sectional view taken along line A-A' of FIG. 1. Also, FIG. 3 is an exploded perspective view of the power inductor in accordance with an exemplary embodiment, and FIG. 4 is a plan view of a base and a coil pattern. Also, FIGS. 5 to 9 are a particle size distribution view and an SEM photograph of magnetic powder used in the power inductor in accordance with an exemplary embodiment. Also, FIGS. 10 and 11 are cross-sectional views for explaining a shape of a coil pattern, and FIGS. 12 and 13 are cross-sectional photographs of the power inductor depending on materials of an insulation layer. FIG. 14 is a side view illustrating the power inductor in accordance with a modified example of an exemplary embodiment.

Referring to FIGS. 1 to 4, a power inductor in accordance with an exemplary embodiment may include a body 100 (100*a* and 100*b*), a base 200 provided in the body 100, coil patterns 300 (310 and 320) disposed on at least one surface of the base 200, external electrodes 400 (410 and 420) disposed outside the body 100, and an insulation layer 500 disposed between the coil patterns 310 and 320 and the body 100. Also, although not shown, the power inductor may further include a surface modification member disposed on at least one surface of the body 100 and a capping insulation layer 550 disposed on a top surface of the body 100.

1. Body

The body 100 may have a hexahedral shape. That is, the body 100 may have an approximately hexahedral shape having a predetermined length in an X direction, a predetermined width in a Y direction, and a predetermined height in a Z direction. Here, the body 100 may have the length that is greater than each of the width and height and have the width that is equal to or different from the height. Of course, the body 100 may have a polyhedral shape in addition to the hexahedral shape. The body 100 may include magnetic powder 110 and a polymer 120 and may further include a thermal conductive filler. Here, the body 100 may have at least one region in which particle size distribution of the magnetic powder 110 is different. That is, the body 100 may be provided as a layer having a predetermined thickness in a region, in which the particles have the same size, in a thickness direction, i.e., the Z direction. The body 100 may have at least one surface of which specific resistance is higher than that of the other surface or the inside thereof. For example, specific resistance on one surface of the body 100 on which the external electrode 400 mounted on a printed circuit board is disposed, i.e., at least one surface of two surfaces facing each other in the Z direction may be higher than that of each of two surfaces facing each other in the X direction and two surfaces facing each other in the Y direction.

1.1. Magnetic Powder

Figure 5:
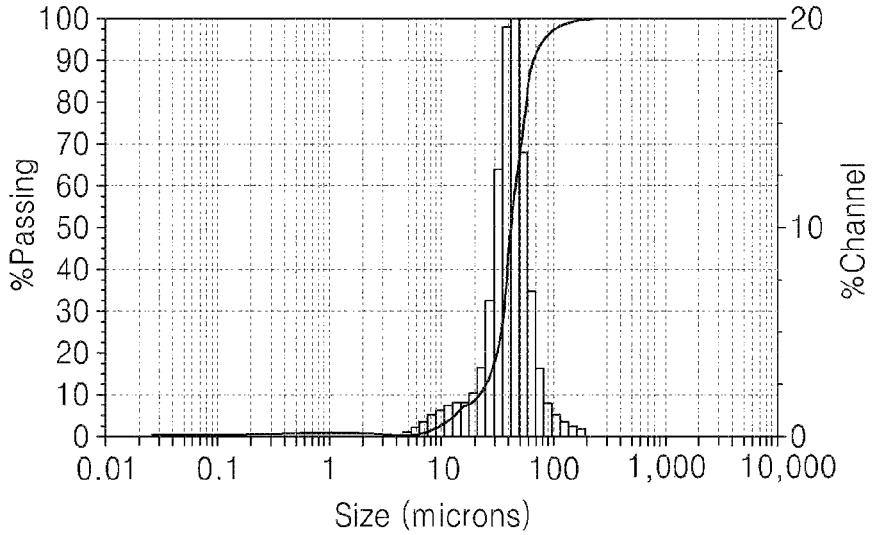
FIGS. 5 to 9 are a particle size distribution view and an SEM photograph of magnetic powder used in the power inductor in accordance with an exemplary embodiment.
Figure 5:
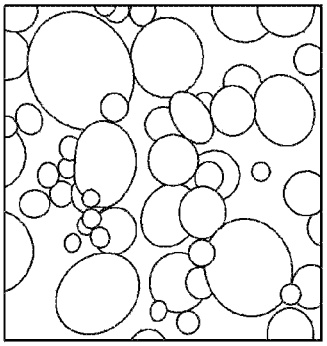
Figure 6:
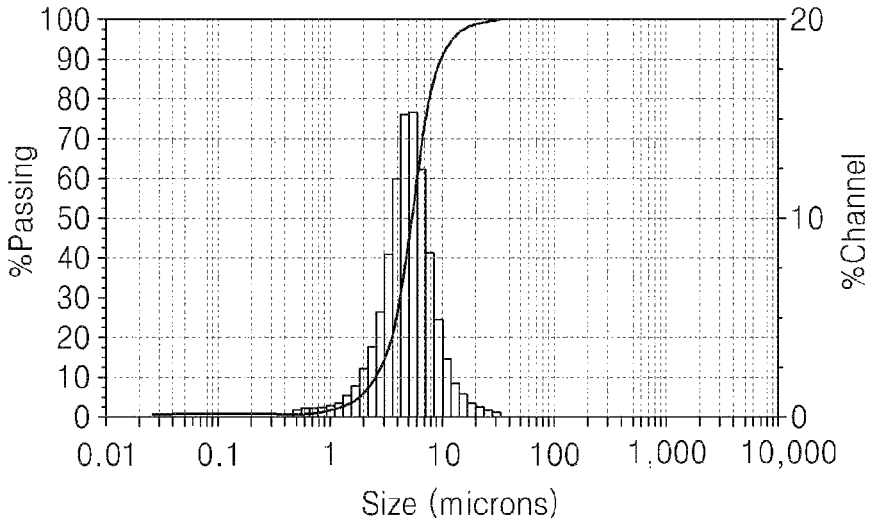
Figure 6:
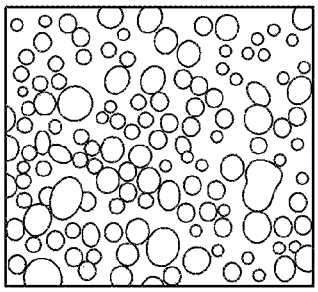
Figure 7:
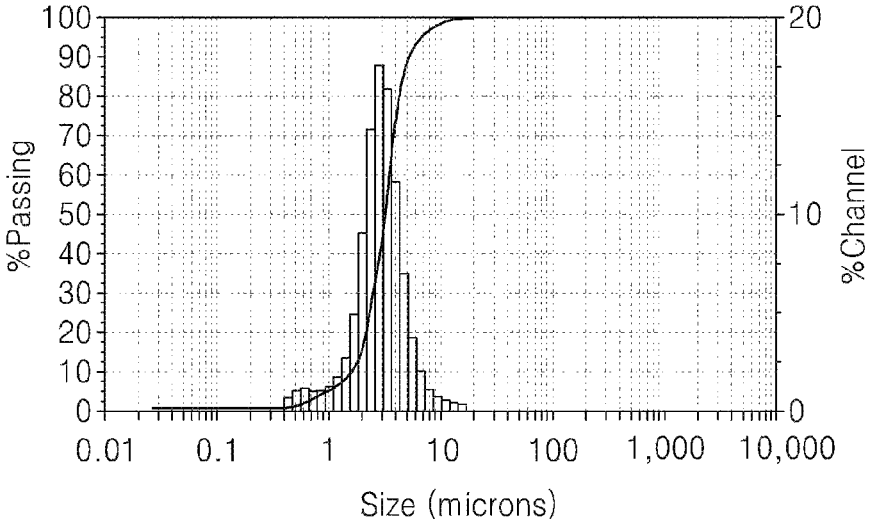
Figure 7:
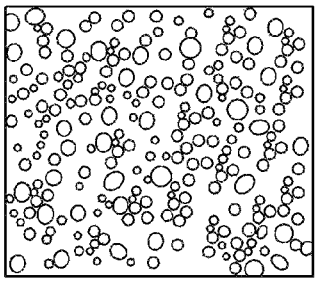

The magnetic powder 110 may have a mean size, i.e., a mean particle diameter of 1 μm to 100 μm. Also, one kind of particles having the same size or at least two kinds of particles may be used as the magnetic powder 110, or one kind of particles having a plurality of sizes or at least two kinds of particles may be used as the magnetic powder 110. When the magnetic powder 110 has a plurality of sizes, first magnetic powder having a mean particle diameter of 20 μm to 100 μm, second magnetic powder having a mean particle diameter of 2 μm to 20 μm, and third magnetic powder having a mean particle diameter of 1 μm to 10 μm may be mixed with each other to be used as the magnetic powder 110. Here, the first magnetic powder may have a size greater than or equal to that of the second magnetic powder, and the second magnetic powder may have a size greater than or equal to that of the third magnetic powder. That is, when a mean particle diameter of the first magnetic powder is A, a mean particle diameter of the second magnetic powder is B, and a mean particle diameter of the third magnetic powder is C, a ratio of A:B:C may be a ratio of 20 to 100:2 to 20:1 to 10. For example, a ratio of A:B:C may be 20:1.5:1 or 10:1.5:1. FIGS. 5 to 7 illustrate grain-size distribution and SEM photographs of the first to third magnetic powder. That is, (a) of FIGS. 5 to 7 illustrate graphs of the grain-size distribution of the first to third magnetic powder, and (b) of FIGS. 5 to 7 illustrate SEM photographs of the first to third magnetic powder having the grain-size distribution illustrated in (a) of FIGS. 5 to 7. The first, second, and third magnetic powder may be powder made of the same material or powder made of materials different from each other.

Also, at least first region of the body 100 may be formed by using the magnetic powder 110 in which a mean value of the particle sizes or a middle value D50 of the grain-side distribution is small, and at least second region of the body 100 may be formed by using at least two magnetic powder 110 in which the mean values of the particle sizes or the middle values D50 of the grain-size distribution are different from each other. That is, at least a portion of the body 100 in the Z direction may be formed at a predetermined thickness by containing one of the first to third magnetic powder, and the rest portion of the body 100 may be formed at a predetermined thickness by mixing the first to third magnetic powder. For example, a first thickness of the body 100 coming into contact with the insulation layer 500 at a middle portion of the body 100, i.e., upper and lower portions of the insulation layer 500 may be formed by using the magnetic powder 110 in which the mean value of the particle sizes or the middle value D50 of the grain-size distribution is largest, i.e., at least one of the second and third magnetic powder. That is, the first thickness of the body 100 coming into contact with the insulation layer 500 may be defined by containing at least one of the second and third magnetic powder, preferably, the magnetic powder (i.e., the third magnetic powder) having the smallest size. Here, the first thickness of the body 100 may be formed to a thickness at which the magnetic powder having the largest size does not contact with the insulation layer 500 or at which the magnetic powder is prevented from coming into contact with the coil pattern due to the insulation breakdown of the insulation layer 500. For example, the first thickness may be a thickness corresponding to 1% to 10% of a thickness of the laminate 100 from a surface of each of the upper and lower insulation layers 500, particularly, a thickness of 10 μm to 100 μm. That is, the first thickness of the body 100 may be equal to or greater than that of the insulation layer 500. The body 100 having the first thickness from the surface of the insulation layer 500 may be manufactured by containing the magnetic powder in which the mean value of the particle sizes or the middle value D50 of the grain-size distribution is lowest, i.e., the third magnetic powder to prevent the insulation breakdown from occurring by the magnetic powder having the large size, thereby prevent the inductance from being deteriorated. Also, the predetermined second thickness from a region formed by allowing the external electrode 400 to extend, i.e., the top and bottom surfaces of the body 100 in the Z direction may be formed by containing at least one of the second and third magnetic powder, preferably, the magnetic powder (i.e., the third magnetic powder) having the smallest size. Here, the second thickness may correspond to 1% to 10% to the thickness of the lamination 100. Particularly, the second thickness may range of 10 μm to 100 μm. Since the uppermost and lowermost portions of the body 100 are formed by containing the magnetic powder having the smallest size, the polymer 120 may increase in content at the corresponding portions. Thus, the specific resistance on the upper and lower surfaces may increase to prevent the external electrode 400 from being delaminated or peeled, thereby easily forming the external electrode 400. Also, the remaining region except for the middle, uppermost, and lowermost portions of the body 100 formed by using the magnetic powder having the smallest size, i.e., the third magnetic powder may be formed by mixing the first to third magnetic powder. That is, a region between the middle, uppermost, and lowermost portions of the body 100 may be formed by mixing the first to third magnetic powder. Here, a mixing ratio of the first, second, and third magnetic powder may be 5 to 9:0.5 to 2.5:0.5 to 2.5, preferably, 8:1:1. That is, 50 wt % to 90 wt % of the first magnetic powder, 5 wt % to 25 wt % of the second magnetic powder, and 5 wt % to 25 wt % of the third magnetic powder with respect to 100 wt % of the magnetic powder 110 may be mixed. Here, an amount of first magnetic powder may be greater than that of second magnetic powder, and an amount of second magnetic powder may be less than or equal to that of third magnetic powder. Preferably, 80 wt % of the first magnetic powder, 10 wt % of the second magnetic powder, and 10 wt % of the third magnetic powder with respect to 100 wt % of the magnetic powder 110 may be mixed. As described above, the predetermined thickness of at least one of the middle portion of the body 100, the uppermost portion of the body 100, and the lowermost portion of the body 100 may be formed by containing the magnetic powder in which the mean value of the particle sizes or the grain-size distribution is lowest, i.e., the third magnetic powder, and the rest thickness of the body 100 may be defined by containing the mixture of the first to third magnetic powder. That is, the body 100 may have at least one region that is layered to contain the third magnetic powder. When a plurality of sheets are laminated to form the body 100, at least one sheet corresponding to each of the middle, uppermost, and lowermost portions of the body 100 may be formed by containing the third magnetic powder. That is, since at least one sheet coming into contact with the insulation layer 500 may be formed by containing the magnetic powder having the smallest size to prevent the insulation breakdown from occurring. In addition, at least one sheet of the uppermost and lowermost portions of the body 100 in the Y direction may be formed by containing the magnetic powder having the smallest size to prevent the external electrode 400 from being delaminated or peeled. Also, the first and second thicknesses of the body 100, which are formed by containing the magnetic powder having the smallest size may have a content of the polymer 120, which is greater than that of the polymer 120 in the rest thickness. Particularly, the second thickness from the surface may a content of the polymer 120, which is greater than that of the polymer 120 in the rest thickness. Thus, at least one of the two surfaces facing each other in the Z direction may have specific resistance greater than that of the remaining surface, i.e., each of the two surfaces facing each other in the X direction and the two surfaces facing each other in the Y direction. Also, the first to third magnetic powder may further include at least two magnetic powder different from each other. That is, the first magnetic powder may include at least two magnetic powder having different sizes, for example, first-1 magnetic powder having a mean particle diameter of 50 μm and first-2 magnetic powder having a mean particle diameter of 30 μm. Also, the first magnetic powder may further include first-3 magnetic powder having a mean particle diameter of 40 μm. Of course, each of the second and third magnetic powder may further include magnetic powder having at least two sizes. For example, the second magnetic particles may include second-1 magnetic powder having a mean particle diameter of 15 μm, second-2 magnetic powder having a mean particle diameter of 10 μm, and second-3 magnetic powder having a mean particle diameter of 5 μm. Also, the third magnetic particles may include third-1 magnetic powder having a mean particle diameter of 5 μm, third-2 magnetic powder having a mean particle diameter of 3 μm, and third-3 magnetic powder having a mean particle diameter of 1 μm. Thus, the first thickness of the body 100 coming into contact with the insulation layer 500 and the second thicknesses of the uppermost and lowermost portions of the body 100 may be formed by using at least two magnetic powder different from each other, in which the mean value of the particle sizes or the middle value D50 of the grain-size distribution has 10 μm or less, preferably, 5 μm. The first to third magnetic powder may be prepared by performing sieving. For example, each of the first to third magnetic powder may include at least two magnetic powder having at least two mean sizes, and also, at least one magnetic powder may be prepared by performing the sieving. That is, the magnetic powder may be filtered by using a mesh having an opening with a predetermined size, i.e., a sieve so that magnetic powder having a size equal to or greater than that of the opening is used. For example, the magnetic powder may be sieved by using a sieve having an opening with a size of 50 μm, and thus, the magnetic powder having a size equal to or greater than that of 50 μm may be used. (a) of FIG. 8 illustrates grain-size distribution of the magnetic powder of which the middle value D50 of the grain-size distribution is a size of 55 μm, and (b) of FIG. 8 illustrates an SEM photograph of the magnetic powder. For example, in case of the first magnetic powder including the first-1 magnetic powder having a mean particle diameter of 40 μm to 55 μm and the first-2 magnetic powder having a mean particle diameter of 20 μm to 30 μm, the first-1 magnetic powder may be prepared by performing the sieving, and the first-2 magnetic powder may be prepared without performing the sieving. The first-1 magnetic powder in which the sieving is performed and the first-2 magnetic powder in which the sieving is not performed may be, for example, mixed at a ratio of 0 to 8:0 to 8. That is, 0 wt % to 80 wt % of the first-1 magnetic powder, in which the sieving is performed, and 80 wt % to 0 wt % of the first-2 magnetic powder, in which the sieving is not performed, with respect to 100 wt % of the magnetic powder may be mixed. Here, the sum of the contents of the first-1 magnetic powder and the first-2 magnetic powder may be 80 wt %, and the remaining content of the magnetic powder may be filled with the second and third magnetic powder.

Each of the first, second, and third magnetic powder may include a metal material including iron (Fe), for example, at least one metal selected from the group consisting of Fe—Ni, Fe—Ni—Si, Fe—Al—Si, and Fe—Al—Cr. For example, the first, second, and third magnetic powder may contain 80% or more of Fe and other materials. That is, 80 wt % of Fe and 20 wt % of other materials except for Fe with respect to 100 wt % of the magnetic powder may be contained in the magnetic powder. Also, at least one of the first, second, and third magnetic powder may have a different mixing ratio of the materials. For example, each of the first, second, and third magnetic powder may be an alloy of Fe, Si, and Cr. Here, a Fe content of the first magnetic powder is may be less or greater than a Fe content of each of the second and third magnetic powder. For example, Fe, Si, and Cr may be mixed at a ratio of 80 to 90:5 to 10:1 to 5 in the magnetic powder. Also, Fe, Si, and Cr may be mixed at a ratio of 90 to 95:4 to 6:2 to 4 in each of the second and third magnetic powder. Here, the ratio may be a unit of wt %. That is, Fe, Si, and Cr may be respectively contained at ratios of 80 to 90 wt %, 5 to 10 wt %, and 1 to 5 wt % with respect to 100 wt % of the first magnetic powder, and the remaining material may be impurities. Also, Fe, Si, and Cr may be respectively contained at ratios of 90 wt % to 95 wt %, 4 wt % to 6 wt %, and 2 wt % to 4 wt % with respect to 100 wt % of each of the second and third magnetic powder, and the remaining material may be impurities. That is, in each of the first, second, and third magnetic powder, the Fe content may be greater than the Si content, and the Si content may be greater than the Cr content. Also, in the second and third magnetic powder, the contents of Fe, Si, and Cr may be different from each other. For example, the second magnetic powder may have the Fe and Si contents greater than those of the third magnetic powder and the Cr content less than that of the third magnetic powder.

Also, the magnetic powder may further include fourth magnetic powder containing iron and having a composition different from that of each of the first to third magnetic powder. For example, the fourth magnetic powder may have a composition containing Fe, C, O, P, and the like. Here, Fe is contained at a ratio of 85% to 90%, and the remaining material may be contained at a ratio of 10% to 15%. That is, when the mixture of Fe, C, O, and P has a content of 100 wt %, Fe may have a content of 85 wt % to 90 wt %, and the remaining material may have a content of 10 wt % to 15 wt %. (a) of FIG. 9 illustrates grain-size distribution of the fourth magnetic powder, and (b) of FIG. 9 illustrates an SEM photograph of the grain-size distribution. Thus, the magnetic powder 110 may contain the first to third magnetic powder, the first, second, and fourth magnetic powder, or the first to fourth magnetic powder. Here, the fourth magnetic powder may have the same size and content as the third magnetic powder or may have a size and content less than those of the third magnetic powder. That is, when the magnetic powder 110 includes the fourth magnetic powder instead of the third magnetic powder, i.e., includes first, second, and fourth magnetic powder, the fourth magnetic powder may have a mean particle diameter of 1 μm to 10 μm and be maxed at a ratio of 5 wt % to 25 wt %. However, when the magnetic powder 110 includes the first to fourth magnetic powder, the fourth magnetic powder may have a mean particle diameter, i.e., a mean value D50 of grain-size distribution may be, for example, 0.5 μm to 5 μm and mixed at a ratio of 1 wt % to 10 wt %. That is, 50 wt % to 90 wt % of the first magnetic powder, 5 wt % to 25 wt % of the second magnetic powder, 5 wt % to 25 wt % of the third magnetic powder, and 1 wt % to 10 wt % of the fourth magnetic powder with respect to 100 wt % of the magnetic powder 110 including the first to fourth magnetic powder may be contained. At least one of the first to fourth magnetic powder may be crystalline, and the remaining material may be amorphous. Alternatively, at least one of the first to fourth magnetic powder may be amorphous, and the remaining material may be crystalline. For example, the first to third magnetic powder may be amorphous, and the fourth magnetic powder may be crystalline.

When the magnetic powder 110 includes at least two kinds of magnetic powder 110 having sizes different from each other, the body 100 may increase in filling rate and thus be maximized in capacity. For example, in case of using the magnetic powder having the mean size of 30 μm, a pore may be generated between the magnetic powder, and thus, the filling rate may be reduced. However, the magnetic powder having the size of 3 μm may be mixed between the magnetic powder having the size of 30 μm to increase the filling rate of the magnetic powder within the body 110. Also, as described above, the at least two kinds of magnetic powder 110 having the different sizes may be used to adjust the magnetic permeability according to the sizes of the magnetic powder. That is, as the magnetic powder having a large mean particle diameter may be used, and the mixing ratio increases, the magnetic permeability may increase. In addition, the sieving may be performed to more improve the magnetic permeability.

Also, a surface of the magnetic powder 110 may be coated with a magnetic material, and the magnetic material may have magnetic permeability different from that of the magnetic powder 110. For example, the magnetic material may include a metal oxide magnetic material. The metal oxide magnetic material may include at least one selected from the group consisting of a Ni oxide magnetic material, a Zn oxide magnetic material, a Cu oxide magnetic material, a Mn oxide magnetic material, a Co oxide magnetic material, a Ba oxide magnetic material, and a Ni—Zn—Cu oxide magnetic material. That is, the magnetic material applied to the surface of the magnetic powder 110 may include metal oxide including iron and have magnetic permeability greater than that of the magnetic powder 110. Since the magnetic powder 110 has magnetism, when the magnetic powder 110 come into contact with each other, the insulation therebetween may be broken to cause short-circuit. Thus, the surface of the magnetic powder 110 may be coated with at least one insulation material. For example, the surface of the magnetic powder 110 may be coated with oxide or an insulative polymer material such as parylene, preferably, the surface of the magnetic powder 110 may be coated with the parylene. The parylene may be coated to a thickness of 1 μm to 10 μm. Here, when the parylene is formed to a thickness of 1 μm or less, an insulation effect of the magnetic powder 110 may be deteriorated. When the parylene is formed to a thickness exceeding 10 μm, the magnetic powder 110 may increase in size to reduce distribution of the magnetic powder 110 within the body 100, thereby deteriorating the magnetic permeability. Also, the surface of the magnetic powder 110 may be coated with various insulative polymer materials in addition to the parylene. The oxide applied to the magnetic powder 110 may be formed by oxidizing the magnetic powder 110, and the magnetic powder 110 may be coated with at least one selected from $TiO_2$, $SiO_2$, $ZrO_2$, $Sn_{02}$, NiO, ZnO, CuO, CoO, MnO, MgO, $Al_2O_3$, $Cr_2O_3$, $Fe_2O_3$, $B_2O_3$, and $Bi_2O_3$. Here, the magnetic powder 110 may be coated with oxide having a double structure, for example, may be coated with a double structure of the oxide and the polymer material. Alternatively, the surface of the magnetic powder 110 may be coated with an insulation material after being coated with the magnetic material. Since the surface of the magnetic powder 110 is coated with the insulation material, the short-circuit due to the contact between the magnetic powder 110 may be prevented. Here, when the magnetic powder 100 is coated with the oxide and the insulation polymer or doubly coated with the magnetic material and the insulation material, the coating material may be coated to a thickness of 1 μm to 10 μm.

1.2. Polymer

The polymer 120 may be mixed with the magnetic powder 110 to insulate the magnetic powder 110 from each other. That is, the magnetic powder 110 may increase in eddy current loss at a high frequency, and thus, in order to reduce the material loss, the polymer 120 may be provided to insulate the magnetic powder 110 from each other. Also, the polymer 120 may serve as a binder with respect to the magnetic powder 110 and also serve as a structural material for maintaining the shape of the body 110 and increase the specific resistance of the power inductor. In addition, the polymer 120 may provide chemical resistance against various organic solvents. The polymer 120 may include at least one polymer selected from the group consisting of epoxy, polyimide, and liquid crystalline polymer (LCP), but is not limited thereto. Also, the polymer 120 may be made of a thermosetting resin to provide insulation between the magnetic powder 110. For example, the thermosetting resin may include at least one selected from the group consisting of a novolac epoxy resin, a phenoxy type epoxy resin, a BPA type epoxy resin), a BPF type epoxy resin), a hydrogenated BPA epoxy resin), a dimer acid modified epoxy resin, a urethane modified epoxy resin), a rubber modified epoxy resin, and a DCPD type epoxy resin. Here, the polymer 120 may be contained at a content of 2.0 wt % to 20.0 wt % with respect to 100 wt % of the material forming the body 100. However, if the content of the polymer 120 increases, a volume fraction of the magnetic powder 110 may be reduced, and thus, it is difficult to properly realize an effect in which a saturation magnetization value increases. Thus, the magnetic permeability of the body 100 may be deteriorated. On the other hand, if the content of the polymer 120 decreases, a strong acid solution or a strong alkali solution that is used in a process of manufacturing the inductor may be permeated inward to reduce inductance properties. Thus, the polymer 120 may be contained within a range in which the saturation magnetization value and the inductance of the magnetic powder 110 are not reduced. Also, the polymer 120 in at least one region of the body 100 may have a content different from that of the polymer 120 in other regions of the body 100. For example, the first and second thickness of the body 100 containing the magnetic powder 110 having the smallest size may have polymer contents greater than that of the polymer 120 in the rest thickness. Particularly, the second thickness from the surface of the body 100 may a content of the polymer 120, which is greater than that of the polymer 120 in the other region. For example, the polymer 120 in the second thickness may have a content of 5 wt % to 10 wt % with respect to the material forming the body 100, and the polymer 120 in the rest thickness may have a content of 2 wt % to 5 wt %. Thus, since the magnetic powder 110 having the smallest size is contained, the content of the polymer 120 may naturally increase. When being mixed, the content of the polymer 120 may artificially increase.

An organic solvent, a curing agent, a wetting agent, a dispersion agent, and the like in addition to the magnetic powder and the polymer 120 forming the body 100 may be further used. That is, sheets each of which has a predetermined thickness may be manufactured by using the magnetic powder 110, the polymer 120, the organic solvent, the curing agent, the wetting agent, and the dispersion agent and then laminated to manufacture the body 100. For example, the magnetic powder 110, the polymer 120, the organic solvent, the curing agent, the wetting agent, and the dispersion agent may be mixed with each other to manufacture paste and then form sheets each of which has a predetermined thickness. The sheets may be laminated to manufacture the body 100. Here, the organic solvent may include at least one kind of material selected from the group consisting of methyl cellosolve, ethyl cellosolve, butyl cellosolve, butyl cellosolve acetate, aliphatic alcohol, terpineol, dihydro-terpineol, ethylene glycol, ethyl carbitol, butyl carbitol, butyl carbitol acetate, texanol, methyl ethyl ketone, ethyl acetate, and cyclohexanone. The curing agent may allow the composition to be easily dried and cured. The curing agent may include at least one selected from the group consisting of an epoxy resin curing agent having an oxirane group, a triglycidyl isocyanurate (TGIC) curing agent having an oxirane group, a curing agent having an isocyanate group, a blocked curing agent having an isocyanate group, a curing agent having a carboxyl end group, and an aliphatic and aromatic curing agent containing an epoxide and an anhydride reactor. With respect to the wetting agent, to increase the magnetic permeability of the body 100 and increase the magnetic flux density, the content of the magnetic powder 110 has to increase, which is a relative decrease in the content of the polymer 120. When the magnetic powder 110 increases in content, and the polymer 120 decreases in content, it is difficult to manufacture the paste due to wettability. The wetting agent may reduce a contact angle between the magnetic powder 110 and the polymer 120 to allow the polymer 120 from being penetrated into the structure of the magnetic powder 110, thereby improving the wettability. The dispersion agent may be selected from surfactants such as aliphatic polycarboxylic acid ester, unsaturated fatty acid amine salt, and sorbitan monooleate and a polymer compound such as polyester amine salt and polyamide. Thus, the magnetic powder 110 may be reduced in number of pores and uniformly dispersed by using the above-described materials. To manufacture the body 100 by using the above-described materials, the magnetic powder 110 may be contained to a content of 80 wt % to 90 wt %, the polymer 120 may be contained to a content of 2 wt % to 10 wt %, and the remaining material may be contained at a content of 2 wt % to 10 wt % to manufacture the composition paste. For example, in the contents of the remaining materials, the organic solvent may be contained at a content of 1 wt % to 10 wt %, the curing agent may be contained at a content of 0.1 wt % to 1 wt %, the wetting agent may be contained at a content of 1 wt % to 4 wt %, and the dispersion agent may be contained at a content of 0 wt % to 1 wt %.

1.3. Thermal Conductive Filler

The body 100 may include a thermal conductive filler (not shown) to solve the limitation in which the body 100 is heated by external heat. That is, the magnetic powder 110 of the body 100 may be heated by external heat, and thus, the thermal conductive filler may be provided to easily release the heat of the magnetic powder 110 to the outside. The thermal conductive filler 130 may include at least one selected from the group consisting of MgO, AlN, carbon-based materials, Ni-based ferrite, and Mn-based ferrite, but is not limited thereto. Here, the carbon-based material may include carbon and have various shapes, for example, may include graphite, carbon black, graphene, and the like. Also, the Ni-based ferrite may include NiO.ZnO.CuO—$Fe_2O_3$, and the Mn-based ferrite may include MnO.ZnO.CuO—$Fe_2O_3$. Here, the thermal conductive filler may be made of a ferrite material to improve the magnetic permeability or prevent the magnetic permeability from being deteriorated. The thermal conductive filler may be dispersed and contained in the polymer 120 in the form of powder. Also, the thermal conductive filler may be contained at a content of 0.5 wt % to 3 wt % with respect to 100 wt % of the magnetic powder 110. When the thermal conductive filler has a content less than the above-described range, it may be difficult to obtain a heat releasing effect. On the other hand, when the thermal conductive filler has a content exceeding the above-described range, a content of the magnetic powder 110 may be reduced to deteriorate the magnetic permeability of the body 100. Also, the thermal conductive filler may have a size of, for example, 0.5 μm to 100 μm. That is, the thermal conductive filler may have the same size as the magnetic powder 110 or a size greater or less than that of the magnetic powder 110. The heat releasing effect may be adjusted in accordance with a size and content of the thermal conductive filler. For example, the more the size and content of the thermal conductive filler increase, the more the heat releasing effect may increase. The body 100 may be manufactured by laminating a plurality of sheets, which are made of a material including the magnetic powder 110, the polymer 120, and the thermal conductive filler. Here, when the plurality of sheets are laminated to manufacture the body 100, the thermal conductive fillers of the sheets may have contents different from each other. For example, the more the thermal conductive filler is away upward and downward from the center of the base 200, the more the content of the thermal conductive filler within the sheet may increase. Also, the body 100 may be manufactured by various methods such as a method of printing of paste, which is made of the magnetic powder 110, the polymer 120, and the thermal conductive filler, at a predetermined thickness and a method of pressing the paste into a frame. Here, the number of laminated sheet or the thickness of the paste printed to the predetermined thickness so as to form the body 100 may be determined in consideration of electrical characteristics such as an inductance required for the power inductor. The body 100*a* and 100*b* disposed on upper and lower portions of the base 200 with the base 200 therebetween may be connected to each other through the base 200. That is, at least a portion of the base 200 may be removed, and then a portion of the body 100 may be filled into the removed portion of the base 200. Since at least a portion of the base 200 is removed, and the body 100 is filled into the removed portion, the base 200 may be reduced in surface area, and a rate of the body 100 in the same volume may increase to improve the magnetic permeability of the power inductor.

2. Base

The base 200 may be provided in the body 100. For example, the base 200 may be provided in the body 100 in a long axis direction of the body 100, i.e., a direction of the external electrode 400. Also, at least one base 200 may be provided. For example, at least two bases 200 may be spaced a predetermined distance from each other in a direction perpendicular to a direction in which the external electrode 400 is disposed, for example, in a vertical direction. Of course, at least two bases 200 may be arranged in the direction in which the external electrode 400 is disposed. The base 200 may be provided in a shape in which metal foil is attached to each of upper and lower portions of a base having a predetermined thickness. Here, the base may include, for example, glass reinforced fibers, plastic, metal magnetic materials, and the like. That is, a copper clad lamination (CCL) in which the copper foil is bonded to the glass reinforced fiber may be used as the base 200, or the copper foil may be bonded to the plastic such as polyimide or bonded to a metal magnetic material to manufacture the base 200. Here, the base 200 may be manufactured by using the metal magnetic body to improve the magnetic permeability and facilitate capacity realization. That is, the CCL is manufactured by bonding the copper foil to the glass reinforced fiber. Since the CCL has the magnetic permeability, the power inductor may be deteriorated in magnetic permeability. However, when the metal magnetic body is used as the base 200, since the metal magnetic body has the magnetic permeability, the power inductor may not be deteriorated in magnetic permeability. The base 200 using the metal magnetic body may be manufactured by bonding copper foil to the base having a plate shape having a predetermined thickness, which is made of a metal containing iron, e.g., at least one metal selected from the group consisting of Fe—Ni, Fe—Ni—Si, Fe—Al—Si, and Fe—Al—Cr. That is, an alloy made of at least one metal containing iron may be manufactured in a plate shape having a predetermined thickness, and copper foil may be bonded to at least one surface of the metal plate to manufacture the base 200.

Also, at least one conductive via 210 may be defined in a predetermined area of the base 200. The coil patterns 310 and 320 disposed on the upper and lower portions of the base 200 may be electrically connected to each other through the conductive via 210. A via (not shown) passing through the base 200 in a thickness direction of the base 200 may be formed in the base 200 and then filled through a plating process during the formation of the coil pattern 300 to form the conductive via 210, or the conductive via 210 may be formed by filling conductive paste into the via. However, when the coil pattern 300 is formed, it is preferable to fill the via through the plating. Here, at least one of the coil patterns 310 and 320 may be grown from the conductive via 210, and thus, at least one of the coil patterns 310 and 320 may be integrated with the conductive via 210. Also, at least a portion of the base 200 may be removed. That is, at least a portion of the base 200 may be removed or may not be removed. As illustrated in FIGS. 3 and 4, an area of the base 200, which remains except for an area overlapping the coil patterns 310 and 320, may be removed. For example, the base 200 may be removed to form the through-hole 220 inside the coil patterns 310 and 320 each of which has a spiral shape, and the base 200 outside the coil patterns 310 and 320 may be removed. That is, the base 200 may have a shape along an outer appearance of each of the coil patterns 310 and 320, e.g., a racetrack shape, and an area of the base 200 facing the external electrode 400 may have a linear shape along a shape of an end of each of the coil patterns 310 and 320. Thus, the outside of the base 200 may have a shape that is curved with respect to an edge of the body 100. As illustrated in FIG. 4, the body 100 may be filled into the removed portion of the base 200. That is, the upper and lower bodies 100*a* and 100*b* may be connected to each other through the removed region including the through-hole 220 of the base 200. When the base 200 is manufactured using the metal magnetic material, the base 200 may contact the magnetic powder 110 of the body 100. To solve the above-described limitation, the insulation layer 500 such as parylene may be disposed on a side surface of the base 200. For example, the insulation layer 500 may be disposed on a side surface of the through-hole 220 and an outer surface of the base 200. Also, a region of the body 100, which is adjacent to a side surface of the through-hole 220 and an outer surface of the base 200, may contact the magnetic powder 110 having the smallest size. That is, the first thickness of the body in the region adjacent to the base 200 and the coil pattern 300 may contact the magnetic powder 110 having the smallest size. The base 200 may have a width greater than that of each of the coil patterns 310 and 320. For example, the base 200 may remain with a predetermined width in a directly downward direction of the coil patterns 310 and 320. For example, the base 200 may protrude by a height of about 0.3 μm from each of the coil patterns 310 and 320. Since the base 200 outside and inside the coil patterns 310 and 320 is removed, the base 200 may have a cross-sectional area less than that of the body 100. For example, when the cross-sectional area of the body 100 is defined as a value of 100, the base 200 may have an area ratio of 40 to 80. If the area ratio of the base 200 is high, the magnetic permeability of the body 100 may be reduced. On the other hand, if the area ratio of the base 200 is low, the formation area of the coil patterns 310 and 320 may be reduced. Thus, the area ratio of the base 200 may be adjusted in consideration of the magnetic permeability of the body 100 and a line width and turn number of each of the coil patterns 310 and 320.

3. Coil Pattern

The coil patterns 300 (310 and 320) may be disposed on at least one surface, preferably, both surfaces of the base 200. Each of the coil patterns 310 and 320 may be formed in a spiral shape on a predetermined area of the base 200, e.g., outward from a central portion of the base 200, and the two coil patterns 310 and 320 disposed on the base 200 may be connected to each other to form one coil. That is, each of the coil patterns 310 and 320 may have a spiral shape from the outside of the through-hole 220 defined in the central portion of the base 200. Also, the coil patterns 310 and 320 may be connected to each other through the conductive via 210 provided in the base 200. Here, the upper coil pattern 310 and the lower coil pattern 320 may have the same shape and the same height. Also, the coil patterns 310 and 320 may overlap each other. Alternatively, the coil pattern 320 may be disposed to overlap an area on which the coil pattern 310 is not disposed. An end of each of the coil patterns 310 and 320 may extend outward in a linear shape and also extend along a central portion of a short side of the body 100. Also, an area of each of the coil patterns 310 and 320 contacting the external electrode 400 may have a width greater than that of the other area as illustrated in FIGS. 3 and 4. Since a portion of each of the coil patterns 310 and 320, i.e., a lead-out part has a relatively wide width, a contact area between each of the coil patterns 310 and 320 and the external electrode 400 may increase to reduce resistance. Alternatively, each of the coil patterns 310 and 320 may extend in a width direction of the external electrode 400 from one area on which the external electrode 400 is disposed. Here, the lead-out part that is led out toward a distal end of each of the coil patterns 310 and 320, i.e., the external electrode 400 may have a linear shape toward a central portion of the side surface of the body 100.

The coil patterns 310 and 320 may be electrically connected to each other by the conductive via 210 provided in the base 200. The coil patterns 310 and 320 may be formed through methods such as, for example, thick-film printing, coating, deposition, plating, and sputtering. Here, the coil patterns 310 and 320 may preferably formed through the plating. Also, each of the coil patterns 310 and 320 and the conductive via 210 may be made of a material including at least one of silver (Ag), copper (Cu), and a copper alloy, but is not limited thereto. When the coil patterns 310 and 320 are formed through the plating process, a metal layer, e.g., a cupper layer is formed on the base 200 through the plating process and then patterned through a lithography process. That is, the copper layer may be formed by using the copper foil disposed on the surface of the base 200 as a seed layer and then patterned to form the coil patterns 310 and 320. Alternatively, a photosensitive pattern having a predetermined shape may be formed on the base 200, and the plating process may be performed to grow a metal layer from the exposed surface of the base 200, thereby forming the coil patterns 310 and 320, each of which has a predetermined shape. The coil patterns 310 and 320 may be formed with a multilayer structure. That is, a plurality of coil patterns may be further disposed above the coil pattern 310 disposed on the upper portion of the base 200, and a plurality of coil patterns may be further disposed below the coil pattern 320 disposed on the lower portion of the base 200. When the coil patterns 310 and 320 are formed with the multilayer structure, the insulation layer may be disposed between a lower layer and an upper layer. Then, the conductive via (not shown) may be formed in the insulation layer to connect the multilayered coil patterns to each other. Each of the coil patterns 310 and 320 may have a height that is greater 2.5 times than a thickness of the base 200. For example, the base may have a thickness of 10 μm to 50 μm, and each of the coil patterns 310 and 320 may have a height of 50 μm to 300 μm.

Also, the coil patterns 310 and 320 in accordance with an exemplary embodiment may have a double structure. That is, as illustrated in FIG. 10, a first plated layer 300*a* and a second plated layer 300*b* configured to cover the first plated layer 300*a* may be provided. Here, the second plated layer 300*b* may be disposed to cover top and side surfaces of the first plated layer 300*a*. Also, the second plated layer 300*b* may be formed so that the top surface of the first plated layer 300*a* has a thickness greater than that of the side surface of the first plated layer 300*a*. The side surface of the first plated layer 300*a* may have a predetermined inclination, and a side surface of the second plated layer 300*b* may have an inclination less than that of the side surface of the first plated layer 300*a*. That is, the side surface of the first plated layer 300*a* may have an obtuse angle from the surface of the base 200 outside the first plated layer 300*a*, and the second plated layer 300*b* has an angle less than that of the first plated layer 300*a*, preferably, a right angle. As illustrated in FIG. 11, a ratio of a width a of a top surface to a width b of a bottom surface of the first plated layer 300*a* may be 0.2:1 to 0.9:1, preferably, a ratio of a:b may be 0.4:1 to 0.8:1. Also, a ratio of a width b to a height h of the bottom surface of the first plated layer 300*a* may be 1:0.7 to 1:4, preferably, 1:1 to 1:2. That is, the first plated layer 300*a* may have a width that gradually decreases from the bottom surface to the top surface. Thus, the first plated layer 300*a* may have a predetermined inclination. An etching process may be performed after a primary plating process so that the first plated layer 300*a* has a predetermined inclination. Also, the second plated layer 300*b* configured to cover the first plated layer 300*a* may have an approximately rectangular shape in which a side surface is vertical, and an area rounded between the top surface and the side surface is less. Here, the second plated layer 300*b* may be determined in shape in accordance with a ratio of the width a of the top surface to the width b of the bottom surface of the first plated layer 300*a*, i.e., a ratio of a:b. For example, the more the ratio (a:b) of the width a of the top surface to the width b of the bottom surface of the first plated layer 300*a* increases, the more a ratio of a width c of the top surface to a width d of the bottom surface of the second plated layer 300*b* increases. However, when the ratio (a:b) of the width a of the top surface to the width b of the bottom surface of the first plated layer 300*a* exceeds 0.9:1, the width of the top surface of the second plated layer 300*b* may be more widened than that of the top surface of the second plated layer 300*b*, and the side surface may have an acute angle with respect to the base 200. Also, when the ratio (a:b) of the width a of the top surface to the width b of the bottom surface of the first plated layer 300*a* is below 0:2:1, the second plated layer 300*b* may be rounded from a predetermined area to the top surface. Thus, the ratio of the top surface to the bottom surface of the first plated layer 300*a* may be adjusted so that the top surface has the wide width and the vertical side surface. Also, a ratio of the width b of the bottom surface of the first plated layer 300*a* to the width d of the bottom surface of the second plated layer 300*b* may be 1:1.2 to 1:2, and a distance between the width b of the bottom surface of the first plated layer 300*a* and the adjacent first plated layer 300*a* may have a ratio of 1.5:1 to 3:1. Alternatively, the second plated layers 300*b* may not contact each other. A ratio (c:d) of the widths of the top to bottom surfaces of the coil patterns 300 constituted by the first and second plated layers 300*a* and 300*b* may be 0.5:1 to 0.9:1, preferably, 0.6:1 to 0.8:1. That is, a ratio of widths of the top surface to the bottom surface of an outer appearance of the coil pattern 300, i.e., an outer appearance of the second plated layer 300*b* may be 0.5:1 to 0.9:1. Thus, the coil pattern 300 may have a ratio of 0.5 or less with respect to an ideal rectangular shape in which the rounded area of the edge of the top surface has a right angle. For example, the coil pattern 300 may have a ratio ranging from 0.001 to 0.5 with respect to the ideal rectangular shape in which the rounded area of the edge of the top surface has the right angle. Also, the coil pattern 300 in accordance with an exemplary embodiment may have a relatively low resistance variation when compared to a resistance variation of the ideal rectangular shape. For example, if the coil pattern having the ideal rectangular shape has resistance of 100, resistance the coil pattern 300 may be maintained between values of 101 to 110. That is, the resistance of the coil pattern 300 may be maintained to about 101% to about 110% in accordance with the shape of the first plated layer 300*a* and the shape of the second plated layer 300*b* that varies in accordance with the shape of the first plated layer 300*a* when compared to the resistance of the ideal coil pattern having the rectangular shape. The second plated layer 300*b* may be formed by using the same plating solution as the first plated layer 300*a*. For example, the first and second plated layers 300*a* and 300*b* may be formed by using a plating solution that is based on copper sulfate and sulfuric acid. Here, the plating solution may be improved in plating property of a product by adding chlorine (Cl) having a ppm unit and an organic compound. The organic compound may be improved in uniformity and throwing power of the plated layer and gloss characteristics by using a carrier and a polish.

Also, the coil pattern 300 may be formed by laminating at least two plated layers. Here, each of the plated layers may have a vertical side surface and be laminated in the same shape and at the same thickness. That is, the coil pattern 300 may be formed on a seed layer through a plating process. For example, three plated layers may be laminated on the seed layer to form the coil pattern 300. The coil pattern 300 may be formed through an anisotropic plating process and have an aspect ratio of approximately 2 to approximately 10.

Also, the coil pattern 300 may have a shape of which a width gradually increases from the innermost circumferential portion to the outermost circumferential portion thereof. That is, the coil pattern 300 having the spiral shape may include n patterns from the innermost circumference to the outermost circumference. For example, when four patterns are provided, the patterns may have widths that gradually increase in order of a first pattern that is disposed on the innermost circumference, a second pattern, a third pattern, and a fourth pattern that is disposed on the outermost circumference. For example, when the width of the first pattern is 1, the second pattern may have a ratio of 1 to 1.5, the third pattern may have a ratio of 1.2 to 1.7, and the fourth pattern may have a ratio of 1.3 to 2. That is, the first to fourth patterns may have a ratio of 1:1 to 1.5:1.2 to 1.7:1.3 to 2. That is, the second pattern may have a width equal to or greater than that of the first pattern, the third pattern may have a width greater than that of the first pattern and equal to or greater than that of the second pattern, and the fourth pattern may have a width greater than that of each of the first and second patterns and equal to or greater than that of the third pattern. The seed layer may have a width that gradually increases from the innermost circumference to the outermost circumference so that the coil pattern has the width that gradually increases from the innermost circumference to the outermost circumference. Also, widths of at least one region of the coil pattern in a vertical direction may be different from each other. That is, a lower end, an intermediate end, and an upper end of the at least one region may have widths different from each other.

4. External Electrode

The external electrodes 410 and 420 (400) may be disposed on two surfaces facing each other of the body 100. For example, the external electrodes 410 and 420 may be disposed on two side surfaces of the body 100, which face each other in the X direction. The external electrodes 400 may be electrically connected to the coil patterns 310 and 320 of the body 100. Also, the external electrodes 400 may be disposed on the two side surfaces of the body 100 to contact the coil patterns 310 and 320 at central portions of the two side surfaces, respectively. That is, an end of each of the coil patterns 310 and 320 may be exposed to the outer central portion of the body 100, and each of the external electrodes 400 may be disposed on the side surface of the body 100 and then connected to the end of each of the coil patterns 310 and 320. The external electrode 400 may be formed by using conductive paste. That is, both side surfaces of the body 100 may be immersed into the conductive paste, or the conductive paste may be printed on both side surfaces of the body 100 to form the external electrode 400. Also, the external electrode 400 may be formed through various methods such as deposition, sputtering, and plating. The external electrode 400 may be formed on both side surfaces and only the bottom surface of the body 100. Alternatively, the external electrode 400 may be formed on the top surface or front and rear surfaces of the body 100. For example, when the body 100 is immersed into the conductive paste, the external electrode 400 may be formed on both side surfaces in the X direction, the front and rear surfaces in the Y direction, and the top and bottom surfaces in the Z direction. On the other hand, when the external electrode 400 is formed through the methods such as the printing, the deposition, the sputtering, and the plating, the external electrode 400 may be formed on both side surfaces in the X direction and the bottom surface in the Y direction. Alternatively, although the external electrode 400 is formed through a method except for the immersing method, the external electrode may be disposed on a portion of the other surface adjacent to the two side surfaces facing each other in the X direction of the body 400. That is, the external electrode 400 may be formed on other areas in accordance with the formation method or process conditions as well as both side surfaces in the X direction and the bottom surface on which a printed circuit board is mounted. The external electrode 400 may be made of a metal having electrical conductivity, e.g., at least one metal selected from the group consisting of gold, silver, platinum, copper, nickel, palladium, and an alloy thereof. Here, at least a portion of the external electrode 400 connected to the coil pattern 300, i.e., a portion of the external electrode 400 connected to the coil pattern 300 disposed on the surface of the body 100 may be formed of the same material as the coil pattern 300. For example, when the coil pattern 300 is formed by using copper through the plating process, at least a portion of the external electrode 400 may be formed by using copper. Here, as described above, the copper may be deposited or printed through the immersion or printing method using the conductive paste or may be deposited, printed, or plated through the methods such as the deposition, sputtering, and plating. Preferably, the external electrode 400 may be formed through the plating. The seed layer is formed on both side surfaces of the body 100 so that the external electrode 400 is formed through the plating process, and then, the plated layer may be formed from the seed layer to form the external electrode 400. Here, at least a portion of the external electrode 400 connected to the coil pattern 300 may be the entire side surface or a portion of the body 100 on which the external electrode 400 is disposed. When the external electrode 400 is formed, if the polymer 120 on the surface of the body 100 is low in contact to reduce the specific resistance, the delamination or the peeling of the external electrode 400 may occur. However, the magnetic powder 110 on at least one surface of the body 100 may decrease in size to increase a content of the polymer 120 and thus increase the specific resistance, thereby preventing the external electrode from being delaminated or peeled. Alternatively, a surface modification member may be provided to prevent the external electrode 400 from being delaminated or peeled. Also, the external electrode 400 may further include at least one plated layer. That is, the external electrode 400 may include a first layer connected to the coil pattern 300 and at least plated layer disposed on a top surface of the first layer. For example, the external electrode 400 may further include a nickel-plated layer (not shown) and a tin-plated layer (not shown). That is, the external electrode 400 may have a laminated structure of a copper layer, an Ni-plated layer, and an Sn-plated layer or a laminated structure of a copper layer, an Ni-plated layer, and an Sn/Ag-plated layer. Here, the plated layer may be formed through electrolytic plating or electroless plating. The Sn-plated layer may have a thickness equal to or greater than that of the N-plated layer. For example, the external electrode 400 may have a thickness of 2 μm to 100 μm. Here, the Ni-plated layer may have a thickness of 1 μm to 10 μm, and the Sn or Sn/Ag-plated layer may have a thickness of 2 μm to 10 μm. Also, the external electrode 400 may be formed by mixing, for example, multicomponent glass frit using Bi2O3 or SiO2 of 0.5% to 20% as a main component with magnetic powder. Here, the mixture of the glass frit and the magnetic powder may be manufactured in the form of paste and applied to the two surfaces of the body 100. That is, when a portion of the external electrode 400 is formed by using the conductive paste, the glass frit may be mixed with the conductive paste. As described above, since the glass frit is contained in the external electrode 400, adhesion force between the external electrode 400 and the body 100 may be improved, and a contact reaction between the coil pattern 300 and the external electrode 400 may be improved.

5. Insulation Layer

The insulation layer 500 may be disposed between the coil patterns 310 and 320 and the body 100 to insulate the coil patterns 310 and 320 from the magnetic powder 110. That is, the insulation layer 500 may cover the top and side surfaces of each of the coil patterns 310 and 320. Here, the insulation layer 500 may be formed on the top and side surfaces of each of the coil patterns 310 and 320 at substantially the same thickness. For example, the insulation layer 500 may have a thickness ratio of approximately 1 to 1.2:1 at the top and side surfaces of each of the coil patterns 310 and 320. That is, each of the coil patterns 310 and 320 may have the top surface having a thickness greater by 20% than that of the side surface. Preferably, the top and side surfaces may have the same thickness. Also, the insulation layer 500 may cover the base 200 as well as the top and side surfaces of each of the coil patterns 310 and 320. That is, the insulation layer 500 may be formed on an area exposed by the coil patterns 310 and 320 of the base 200 of which a predetermined region is removed, i.e., a surface and side surface of the base 200. The insulation layer 500 on the base 200 may have the same thickness as the insulation layer 500 on the coil patterns 310 and 320. That is, the insulation layer 500 on the top surface of the base 200 may have the same thickness as the insulation layer 500 on the top surface of each of the coil patterns 310 and 320, and the insulation layer 500 on the side surface of the base 200 may have the same thickness as the insulation layer 500 on the side surface of each of the coil patterns 310 and 320. The parylene may be used so that the insulation layer 500 has substantially the same thickness on the coil patterns 310 and 320 and the base 200. For example, the base 200 on which the coil patterns 310 and 320 are formed may be provided in a deposition chamber, and then, the parylene may be evaporated and supplied into the vacuum chamber to deposit the parylene on the coil patterns 310 and 320. For example, the parylene may be primarily heated and evaporated in a vaporizer to become a dimer state and then be secondarily heated and pyrolyzed into a monomer state. Then, when the parylene is cooled by using a cold trap connected to the deposition chamber and a mechanical vacuum pump, the parylene may be converted from the monomer state to a polymer state and thus be deposited on the coil patterns 310 and 320. Alternatively, the insulation layer 500 may be formed of an insulation polymer in addition to the parylene, for example, at least one material selected from epoxy, polyimide, and liquid crystal crystalline polymer. However, the parylene may be applied to form the insulation layer 500 having the uniform thickness on the coil patterns 310 and 320. Also, although the insulation layer 500 has a thin thickness, the insulation property may be improved when compared to other materials. That is, when the insulation layer 500 is coated with the parylene, the insulation layer 500 may have a relatively thin thickness and improved insulation property by increasing a breakdown voltage when compared to a case in which the insulation layer 500 is made of the polyimide. Also, the parylene may be filled between the coil patterns 310 and 320 at the uniform thickness along a gap between the patterns or formed at the uniform thickness along a stepped portion of the patterns. That is, when a distance between the patterns of the coil patterns 310 and 320 is far, the parylene may be applied at the uniform thickness along the stepped portion of the pattern. On the other hand, the distance between the patterns is near, the gap between the patterns may be filled to form the parylene at a predetermined thickness on the coil patterns 310 and 320. FIG. 12 is a cross-sectional photograph of the power inductor in which the insulation layer is made of polyimide, and FIG. 13 is a cross-sectional photograph of the power inductor in which the insulation layer is made of parylene. As illustrated in FIG. 13, in case of the parylene, although the parylene has a relatively thin thickness along the stepped portions of the base 200 and the coil patterns 310 and 320, the polyimide may have a thickness greater than that of the parylene as illustrated in FIG. 12. The insulation layer 500 may have a thickness of 3 μm to 100 μm by using the parylene. When the parylene is formed at a thickness of 3 μm or less, the insulation property may be deteriorated. When the parylene is formed at a thickness exceeding 100 μm, the thickness occupied by the insulation layer 500 within the same size may increase to reduce a volume of the body 100, and thus, the magnetic permeability may be deteriorated. Alternatively, the insulation layer 500 may be manufactured in the form of a sheet having a predetermined thickness and then formed on the coil patterns 310 and 320.

6. Surface Modification Member

A surface modification member (not shown) may be formed on at least one surface of the body 100. The surface modification member may be formed by dispersing oxide onto the surface of the body 100 before the external electrode 400 is formed. Here, the oxide may be dispersed and distributed onto the surface of the body 100 in a crystalline state or an amorphous state. The surface modification member may be distributed on the surface of the body 100 before the plating process when the external electrode 400 is formed through the plating process. That is, the surface modification member may be distributed before the printing process is performed on a portion of the external electrode 400 or be distributed before the plating process is performed after the printing process is performed. Alternatively, when the printing process is not performed, the plating process may be performed after the surface modification member is distributed. Here, at least a portion of the surface modification member distributed on the surface may be melted.

At least a portion of the surface modification member may be uniformly distributed on the surface of the body with the same size, and at least a portion may be non-uniformly distributed with sizes different from each other. Also, a recess part may be formed in a surface of at least a portion of the body 100. That is, the surface modification member may be formed to form a convex part. Also, at least a portion of an area on which the surface modification member is not formed may be recessed to form the concave part. Here, at least a portion of the surface modification member may be recessed from the surface of the body 100. That is, a portion of the surface modification member, which has a predetermined thickness, may be inserted into the body 100 by a predetermined depth, and the rest portion of the surface modification member may protrude from the surface of the body 100. Here, the portion of the surface modification member, which is inserted into the body 100 by the predetermined depth, may have a diameter corresponding to 1/20 to 1 of a mean diameter of oxide particles. That is, all the oxide particles may be impregnated into the body 100, or at least a portion of the oxide particles may be impregnated. Alternatively, the oxide particles may be formed on only the surface of the body 100. Thus, each of the oxide particles may be formed in a hemispherical shape on the surface of the body 100 and in a globular shape. Also, as described above, the surface modification member may be partially distributed on the surface of the body or distributed in a film shape on at least one area of the body 100. That is, the oxide particles may be distributed in the form of an island on the surface of the body 100 to form the surface modification member. That is, the oxide particles having the crystalline state or the amorphous state may be spaced apart from each other on the surface of the body 100 and distributed in the form of the island. Thus, at least a portion of the surface of the body 100 may be exposed. Also, at least two oxide particles may be connected to each other to form the film on at least one area of the surface of the body 100 and the island shape on at least a portion of the surface of the body 100. That is, at least two oxide particles may be aggregated, or the oxide particles adjacent to each other may be connected to each other to form the film. However, although the oxide exists in the particle state, or at least two particles are aggregated with or connected to each other, at least a portion of the surface of the body 100 may be exposed to the outside by the surface modification member.

Here, the total area of the surface modification member may correspond to 5% to 90% of the entire area of the surface of the body 100. Although a plating blurring phenomenon on the surface of the body 100 is controlled in accordance with the surface area of the surface modification member, if the surface modification member is widely formed, the contact between the conductive pattern and the external electrode 400 may be difficult. That is, when the surface modification member is formed on an area of 5% or less of the surface area of the body 100, it may be difficult to control the plating blurring phenomenon. When the surface modification member is formed on an area exceeding 90%, the conductive pattern may not contact the external electrode 400. Thus, it is preferable that a sufficient area on which the plating blurring phenomenon of the surface modification member is controlled, and the conductive pattern contacts the external electrode 400 is formed. For this, the surface modification member may be formed with a surface area of 10% to 90%, preferably, 30% to 70%, more preferably, 40% to 50%. Here, the surface area of the body 100 may be a surface area of one surface thereof or a surface area of six surfaces of the body 100, which define a hexahedral shape. The surface modification member may have a thickness of 10% or less of the thickness of the body 100. That is, the surface modification member may have a thickness of 0.01% to 10% of the thickness of the body 100. For example, the surface modification member may have a size of 0.1 μm to 50 μm. Thus, the surface modification member may have a thickness of 0.1 μm to 50 μm from the surface of the body 100. That is, the surface modification member may have a thickness of 0.1% to 50% of the thickness of the body 100 except for the portion inserted from the surface of the body 100. Thus, the surface modification member may have a thickness greater than that of 0.1 μm to 50 μm when the thickness of the portion inserted into the body 100 is added. That is, when the surface modification member has a thickness of 0.01% or less of the thickness of the body 100, it may be difficult to control the plating blurring phenomenon. When the surface modification member has a thickness exceeding 10%, the conductive pattern within the body 100 may not contact the external electrode 400. That is, the surface modification member may have various thicknesses in accordance with material properties (conductivity, semiconductor properties, insulation, magnetic materials, and the like) of the body 100. Also, the surface modification member may have various thicknesses in accordance with sizes, distributed amount, whether the aggregation occurs, and the like) of the oxide powder.

Since the surface modification member is formed on the surface of the body 100, two areas, which are made of components different from each other, of the surface of the body 100 may be provided. That is, components different from each other may be detected from the area on which the surface modification member is formed and the area on which the surface modification member is not formed. For example, a component due to the surface modification member, i.e., oxide may exist on the area on which the surface modification member is formed, and a component due to the body 100, i.e., a component of the sheet may exist on the area on which the surface modification member is not formed. Since the surface modification member is distributed on the surface of the body before the plating process, roughness may be given to the surface of the body 100 to modify the surface of the body 100. Thus, the plating process may be uniformly performed, and thus, the shape of the external electrode 400 may be controlled. That is, specific resistance on at least an area of the surface of the body 100 may be different from that on the other area of the surface of the body 100. When the plating process is performed in a state in which the specific resistance is non-uniform, ununiformity in growth of the plating layer may occur. To solve this limitation, the oxide that is in a particle state or melted state may be dispersed on the surface of the body 100 to form the surface modification member, thereby modifying the surface of the body 100 and controlling the growth of the plated layer. That is, in the state in which the specific resistance on at least one surface of the body 100 is high, and the surface modification member may be provided.

Here, at least one oxide may be used as the oxide, which is in the particle or melted state, for realizing the uniform surface resistance of the body 100. For example, at least one of $Bi_2O_3$, $BO_2$, $B_2O_3$, ZnO, $Co_3O_4$, $SiO_2$, $Al_2O_3$, MnO, $H_2BO_3$, $Ca(CO_3)_2$, $Ca(NO_3)_2$, and $CaCO_3$ may be used as the oxide. The surface modification member may be formed on at least one sheet within the body 100. That is, the conductive pattern having various shapes on the sheet may be formed through the plating process. Here, the surface modification member may be formed to control the shape of the conductive pattern.

7. Insulation Capping Layer

As illustrated in FIG. 14, an insulation capping layer 550 may be disposed on the top surface of the body 100 on which the external electrode 400 is disposed. That is, the insulation capping layer may be disposed on the bottom surface of the body 100 and the top surface facing the bottom surface of the body 100 mounted on a printed circuit board (PCB), e.g., the top surface of the body 100 in the Z direction. The insulation capping layer 550 may be provided to prevent the external electrode 400 disposed on the top surface of the body 100 to extend from being short-circuited with a shield can or a circuit component disposed above the external electrode 400. That is, in the power inductor, the external electrode 400 disposed on the bottom surface of the body 100 may be adjacent to a power management IC (PMIC) and mounted on the printed circuit board. The PMIC may have a thickness of approximately 1 mm, and the power inductor may also have the same thickness as the PMIC. The PMIC may generate high frequency noises to affect surrounding circuits or devices. Thus, the PMIC and the power inductor may be covered by the shield can that is made of a metal material, e.g., a stainless steel material. However, the power inductor may be short-circuited with the shield can because the external electrode is also disposed thereabove. Thus, the insulation capping layer 500 may be disposed on the top surface of the body 100 to prevent the power inductor from being short-circuited with an external conductor. Here, since the insulation capping layer 550 is provided to insulate the external electrode 400, which is disposed on the top surface of the body 100 to extend, from the shield can, the insulation capping layer 550 may cover the external electrode 400 disposed on the top surface of at least the body 100. The insulation capping layer 550 is made of an insulation material. For example, the insulation capping layer 550 may be made of at least one selected from the group consisting of epoxy, polyimide, and liquid crystalline polymer (LCP). Also, the insulation capping layer 550 may be made of a thermosetting resin. For example, the thermosetting resin may include at least one selected from the group consisting of a novolac epoxy resin, a phenoxy type epoxy resin, a BPA type epoxy resin), a BPF type epoxy resin), a hydrogenated BPA epoxy resin), a dimer acid modified epoxy resin, a urethane modified epoxy resin), a rubber modified epoxy resin, and a DCPD type epoxy resin. That is, the insulation capping layer 550 may be made of a material that is used for the insulation layer 120 of the body 100. The insulation capping layer may be formed by immersing the top surface of the body 100 into the polymer or the thermosetting resin. Thus, as illustrated in FIG. 14, the insulation capping layer 550 may be disposed on a portion of each of both side surfaces in the X direction of the body 100 and a portion of each of the front and rear surfaces in the Y direction as well as the top surface of the body 100. The insulation capping layer 550 may be made of parylene. Alternatively, the insulation capping layer 550 may be made of various insulation materials such as $SiO_2$, $Si_3N_4$, and SiON. When the insulation capping layer 500 is made of the above-described materials, the insulation capping layer 500 may be formed through methods such as CVD and PVD. If the insulation capping layer 500 is formed through the CVD or PVD, the insulation capping layer 550 may be formed on only the top surface of the body 100, i.e., on only the top surface of the external electrode 400 disposed on the top surface of the body 100. The insulation capping layer 550 may have a thickness that is enough to prevent the external electrode 400 disposed on the top surface of the body 100 from being short-circuited with the shield can, e.g., a thickness of 10 μm to 100 μm. Also, the insulation capping layer 550 may be formed at the uniform thickness on the top surface of the body 100 so that a stepped portion is maintained between the external electrode 400 and the body 100. Alternatively, the insulation capping layer 550 may have a thickness on the top surface of the body, which is thicker than that of the top surface of the external electrode 400, and thus be planarized to remove the stepped portion between the external electrode 400 and the body 100. Alternatively, the insulation capping layer 550 may be manufactured with a predetermined thickness and then be adhered to the body 100 by using an adhesive.

As described above, the power inductor in accordance with an exemplary embodiment, the first thickness of the body 100 coming into contact with the insulation layer 500 may be formed by using the magnetic powder 110 having the smallest size. Thus, the insulation breakdown of the insulation layer 500 due to the magnetic powder 110 having the large size may be prevented to prevent the inductance from being deteriorated. Also, the second thickness from an area on which the external electrode 400 mounted on the PCB is formed, for example, the lower surface (and simultaneously the top surface) of the body 100 may be formed by using the magnetic powder 110 having the smallest size. Thus, the polymer 120 on the surface of the body 100 may increase in content to increase the specific resistance, and also prevent the external electrode 400 from being delaminated or peeled, thereby controlling the shape of the external electrode 400. Also, the remaining thickness of the body 100. Here, the body 100 may have at least one region in which particle size distribution of the magnetic powder 110 is different. That is, when the body 100 is made of at least three magnetic powder 110 having mean grain sizes different from each other, a mixing amount of the magnetic powder having a large mean grain size may be adjusted to increase the magnetic permeability of the body 100. Therefore, the powder inductor may be improved in inductance. Also, since the body 100 including the thermal conductive filler in addition to the magnetic powder 110 and the polymer 120 is manufactured, the heat of the body 100 due to the heating of the magnetic powder 110 may be released to the outside to prevent the body from increasing in temperature and also from the inductance from being reduced. Also, since the insulation layer 500 is formed between the coil patterns 310 and 320 and the body 100 by using the parylene, the insulation layer 500 may be formed with a thin thickness on the side surface and the top surface of each of the coil patterns 310 and 320 to improve the insulation property. Also, since the base 200 within the body 100 is made of the metal magnetic material, the decreases of the magnetic permeability of the power inductor may be prevented. Also, at least a portion of the base 200 may be removed, and the body 100 may be filled into the removed portion to improve the magnetic permeability.

Comparative Examples and Embodiment

As described above, at least one region of the body 100 may be formed by containing the magnetic powder having the smallest size to prevent the insulation breakdown from occurring and also prevent the external electrode 400 from being delaminated or peeled. To verify the effect of the power inductor in accordance with an exemplary embodiment, a power inductor in accordance with the related art and an exemplary embodiment was manufactured to observe a cross-section of the power inductors and a shape of an external electrode.

To manufacture the power inductor in accordance with the related art and an exemplary embodiment, first to third magnetic powder were prepared. That is, first magnetic powder having mean grain-size distribution of 52 μm, second magnetic powder having mean grain-size distribution of 8 μm, and third magnetic powder having mean grain-size distribution of 3 μm with respect to D50 were prepared. Here, the first to third magnetic powder have a composition of Fe, Si, and Cr. The magnetic powder having the various sizes were mixed with a polymer, an organic solvent, a curing agent, a wetting agent, and a dispersion agent to manufacture a plurality of slurry. Here, first slurry was manufactured by mixing the first to third magnetic powder at a ratio of 8:1:1, and each of the second and third slurry was manufactured by using only the third magnetic powder. Also, the first to third slurry had different contents of the magnetic powder and the polymer. That is, the first slurry was manufactured by mixing approximately 86 wt % of the magnetic powder, approximately 7 wt % of the organic solvent, approximately 4 wt % of the polymer, approximately 0.4 wt % of the curing agent, approximately 2 wt % of the wetting agent, approximately 0.2 wt of the dispersion agent, and the remaining other materials with each other. Also, the second slurry was manufactured by mixing approximately 80 wt % of the magnetic powder, approximately 10 wt % of the organic solvent, approximately 6 wt % of the polymer, approximately 0.6 wt % of the curing agent, approximately 3 wt % of the wetting agent, approximately 0.3 wt of the dispersion agent, and the remaining other materials with each other. Also, the third slurry was manufactured by mixing approximately 80 wt % of the magnetic powder, approximately 10 wt % of the organic solvent, approximately 6 wt % of the polymer, approximately 0.6 wt % of the curing agent, approximately 3 wt % of the wetting agent, approximately 0 wt of the dispersion agent, and the remaining other materials with each other. That is, the first slurry had a content of the magnetic powder, which is greater than that of each of the first and second slurry, and the third slurry did not have the dispersion agent when compared to the second slurry.

Each of the first to third slurry, which are manufactured as described above, was molded to a thickness of 70 μm±3 μm and cut to a size of 150 mm×150 mm to manufacture a sheet. Also, a coil pattern was formed on each of one surface and the other surface of a CCL base, and then parylene was deposited on the coil pattern. Then, a plurality of sheets were laminated on top and bottom surfaces of the base on which the coil pattern is formed and then compressed for 30 seconds at a pressure of 120 kg f to mold a body, and a thermosetting process was performed for 1 hour at a temperature of 200° C. Here, in the power inductor in accordance with the related art, the body was manufactured by laminating only the sheets manufactured by using the first slurry. In the power inductor in accordance with Embodiments 1 and 2, the uppermost and lowermost sheets coming into contact with an insulation layer were manufactured by using the second and third slurry, and the intermediate sheets were manufactured by using the first slurry. Also, an external electrode was formed on one surface of the body in accordance with the related art and Embodiments 1 and 2. The external electrode was formed to be spaced a predetermined distance from a central portion.

Figure 15:
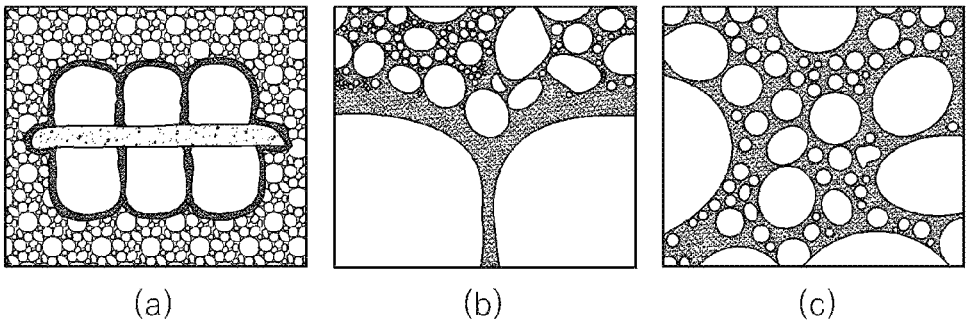
FIGS. 15 to 17 are cross-sectional views of a power inductor in accordance with the related art and exemplary embodiments.
Figure 16:
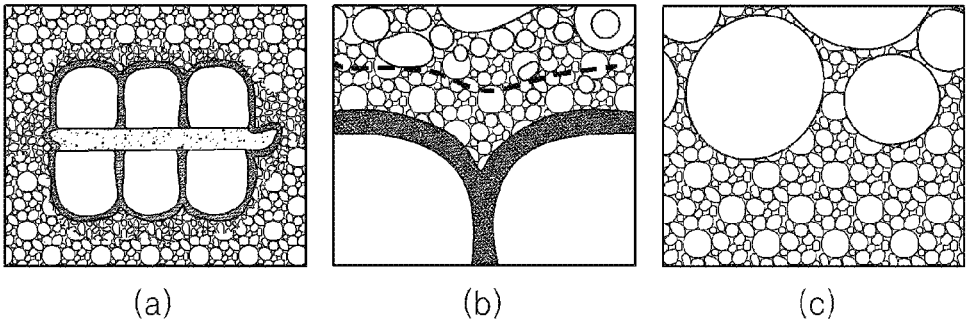
Figure 17:
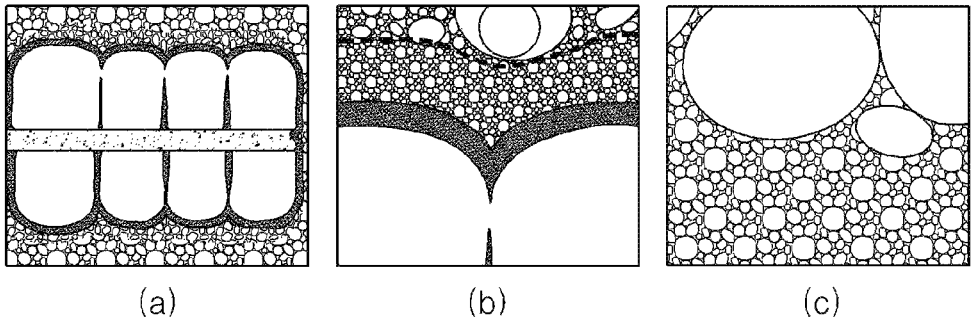
Figure 18:
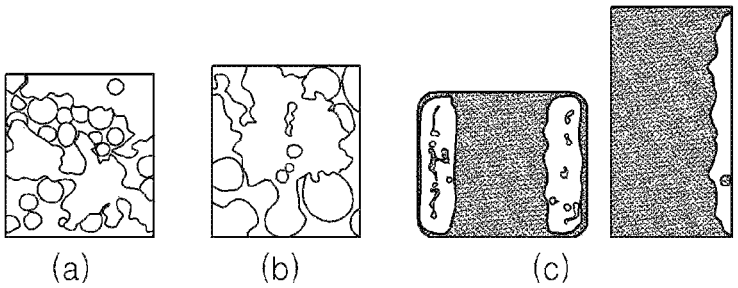
FIGS. 18 to 20 are photographs of a surface and an external electrode of the power inductor in accordance with the related art and exemplary embodiments.
Figure 19:
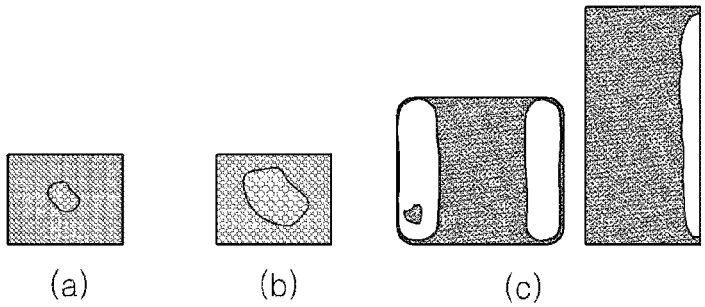
Figure 20:
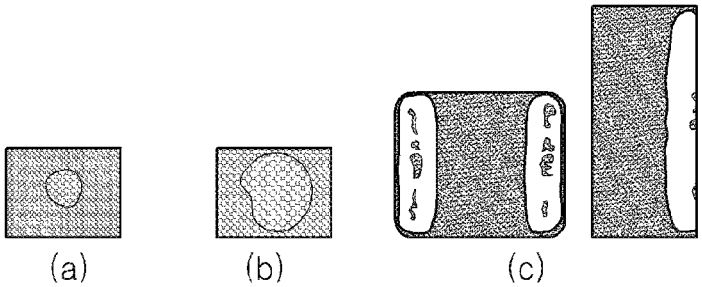

FIGS. 15 to 17 illustrated cross-sectional photographs in accordance with the related art and Embodiments 1 and 2, and FIGS. 18 to 20 illustrated photographs of the surface and the external electrode. (a) of each of FIGS. 15 to 17 is a photograph obtained by magnifying the cross-section 500 times, (b) is a photograph obtained by magnifying the cross-section 2,000 times, and (c) is a photograph obtained by magnifying the surrounding of the insulation 5,000 times. Also, (a) of each of FIGS. 18 to 20 is a photograph obtained by magnifying the surface 1,000 times, (b) is a photograph obtained by magnifying the surface 2,000 times, and (c) is a photograph illustrating a shape of the external electrode.

As illustrated in FIG. 15, in the power inductor in accordance with the related art, it is seen that the magnetic powder having a large size comes into contact with the insulation layer formed on the coil pattern. Particularly, it is seen that the magnetic powder having the large size comes into contact with a recess region between the coil pattern and the coil pattern. Thus, the magnetic powder may pass through the insulation layer to come into contact with the coil pattern. However, as illustrated in FIGS. 16 and 17, in the power inductor in accordance with the exemplary embodiments, it is seen that the magnetic powder having a small size comes into contact with the insulation layer formed on the coil pattern. Thus, the magnetic powder having the large size may not come into contact with the insulation layer to prevent the insulation breakdown from occurring.

Also, as illustrated in FIG. 18, in the power inductor in accordance with the related art, it is seen that the plurality of magnetic powder having different sizes are distributed on the surface to prevent the external electrode from being peeled. However, as illustrated in FIGS. 19 and 20, in the power inductor in accordance with the exemplary embodiments, the magnetic powder having the small size may be distributed on the surface to prevent the external electrode from being peeled.

Embodiment and Modified Example

A power inductor in accordance with various embodiments and modified examples will be described.

Figure 21:
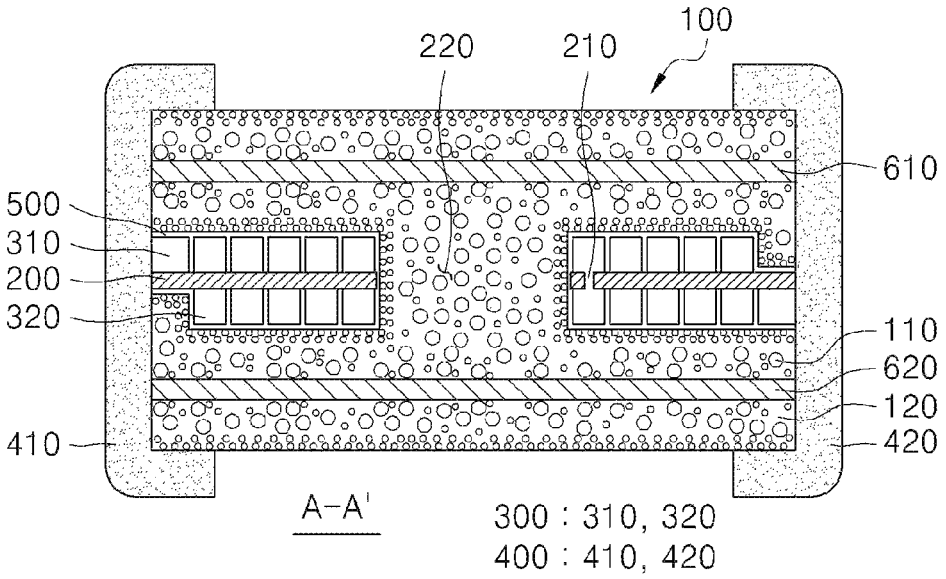
FIG. 21 is a cross-sectional view of a power inductor in accordance with another exemplary embodiment.
Figure 22:
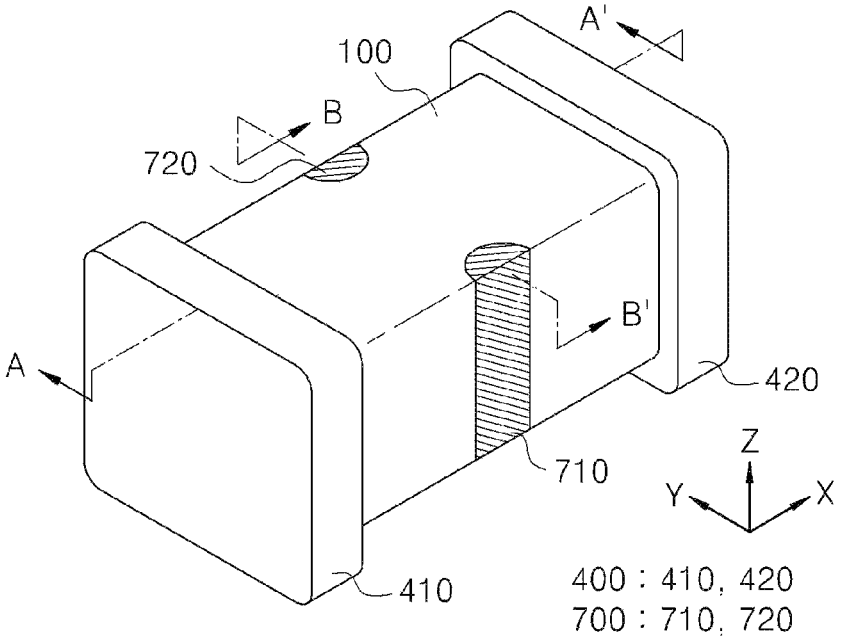
FIG. 22 is a perspective view of a power inductor in accordance with further another exemplary embodiment.

FIG. 21 is a cross-sectional view of a power inductor in accordance with another exemplary embodiment.

Referring to FIG. 21, a power inductor in accordance with another exemplary embodiment may include a body 100, a base 200 provided in the body 100, coil patterns 310 and 320 disposed on at least one surface of the base 200, external electrodes 410 and 420 provided outside the body 100, an insulation layer 500 provided on each of the coil patterns 310 and 320, and at least one magnetic layer 600 (610 and 620) provided in the body 100. That is, another exemplary embodiment may be realized by further providing the magnetic layer 600 in accordance with the foregoing embodiment. Hereinafter, constitutions different from those in accordance with the foregoing embodiment will be mainly described in accordance with another exemplary embodiment.

The magnetic layer 600 (610, 620) may be disposed on at least one area of the body 100. For example, the first and second magnetic layers 610 and 620 may be disposed on top and bottom surfaces of the base 200, respectively. Here, the first and second magnetic layers 610 and 620 may be provided to improve magnetic permeability of the body 100 and also may be made of a material having magnetic permeability greater than that of the body 100. For example, the body 100 may have magnetic permeability of 20, and each of the first and second magnetic layers 610 and 620 may have magnetic permeability of 40 to 1000. Each of the first and second magnetic layers 610 and 620 may be manufactured by using, for example, magnetic powder and a polymer. That is, each of the first and second magnetic layers 610 and 620 may be made of a material having magnetism greater than that of the magnetic material of the body 100 or having a content of the magnetic material greater than that of the magnetic material of the body so as to have magnetic permeability greater than that of the body 100. Here, the polymer may be added to a content of 2 wt % to 5 wt % with respect to 100 wt % of the magnetic powder. Also, the metal powder may use at least one selected from the group consisting of Ni ferrite, Zn ferrite, Cu ferrite, Mn ferrite, Co ferrite, Ba ferrite and Ni—Zn—Cu ferrite or at least one oxide magnetic material thereof. That is, the magnetic layer 600 may be formed by using metal alloy power including iron or metal alloy oxide containing iron. Also, a magnetic material may be applied to the metal alloy powder to form magnetic powder. For example, at least one oxide magnetic material selected from the group consisting of a Ni oxide magnetic material, a Zn oxide magnetic material, a Cu oxide magnetic material, a Mn oxide magnetic material, a Co oxide magnetic material, a Ba oxide magnetic material, and a Ni—Zn—Cu oxide magnetic material may be applied to the metal alloy powder including iron to form the magnetic powder. That is, the metal oxide including iron may be applied to the metal alloy powder to form the magnetic powder. Alternatively, at least one oxide magnetic material selected from the group consisting of a Ni oxide magnetic material, a Zn oxide magnetic material, a Cu oxide magnetic material, a Mn oxide magnetic material, a Co oxide magnetic material, a Ba oxide magnetic material, and a Ni—Zn—Cu oxide magnetic material may be mixed with the metal alloy powder including iron to form the magnetic powder. That is, the metal oxide including iron may be mixed with the metal alloy powder to form the magnetic powder. Each of the first and second magnetic layers 610 and 620 may further include a thermal conductive filler in addition to the magnetic powder and the polymer. The thermal conductive filler may be contained to a content of 0.5 wt % to 3 wt % with respect to 100 wt % of the magnetic powder. The magnetic layer 600 may be manufactured in the form of the sheet and disposed in the body 100 on which the plurality of sheets are laminated. That is, at least one magnetic layer 600 may be provided between the plurality of sheets for manufacturing the body 100. Also, when the paste made of the material including the magnetic powder 110, the polymer 120, and the thermal conductive filler may be printed at a predetermined thickness to form the body 100, the magnetic layer may be formed during the printing. When the paste is put into a frame and then pressed, the magnetic layer may be disposed between the paste and the frame, and then, the pressing may be performed. Of course, the magnetic layer 600 may be formed by using the paste. Here, when the body 100 is formed, a soft magnetic material may be applied to form the magnetic layer 600 within the body 100.

As described above, in the power inductor in accordance with another exemplary embodiment, the at least one magnetic layer 600 may be provided in the body 100 to improve the magnetic permeability of the power inductor.

Figure 23:
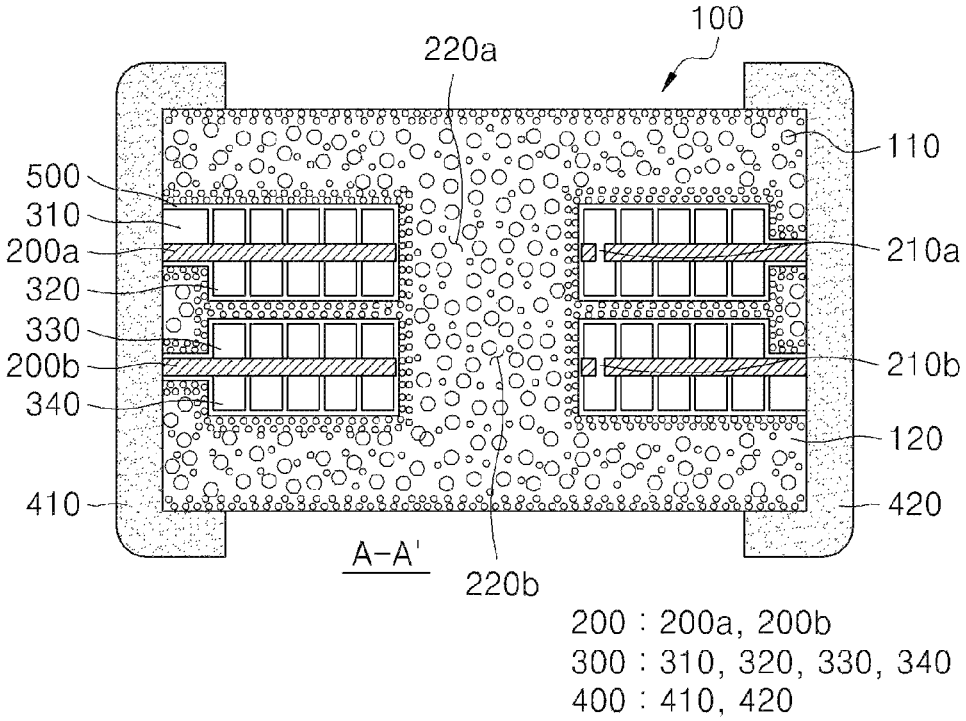
FIGS. 23 and 24 are cross-sectional views taken along lines A-A' and B-B' of FIG. 22.
Figure 24:
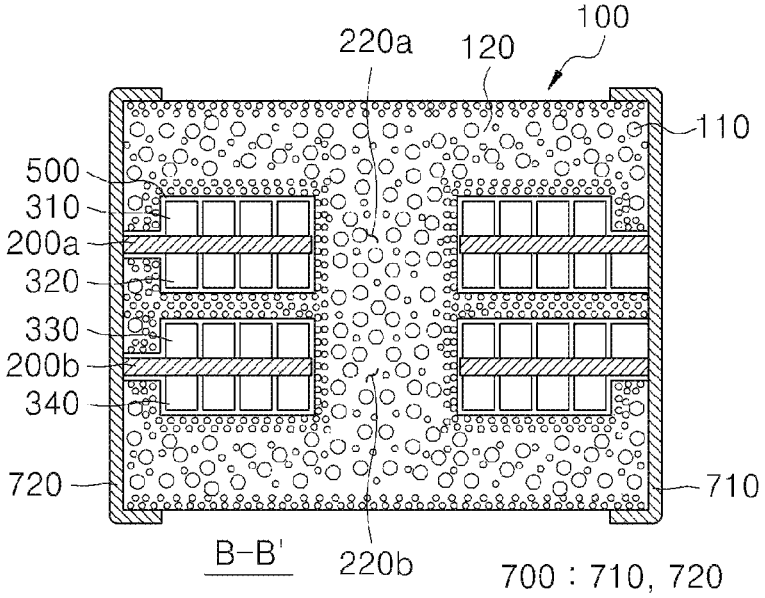
Figure 25:
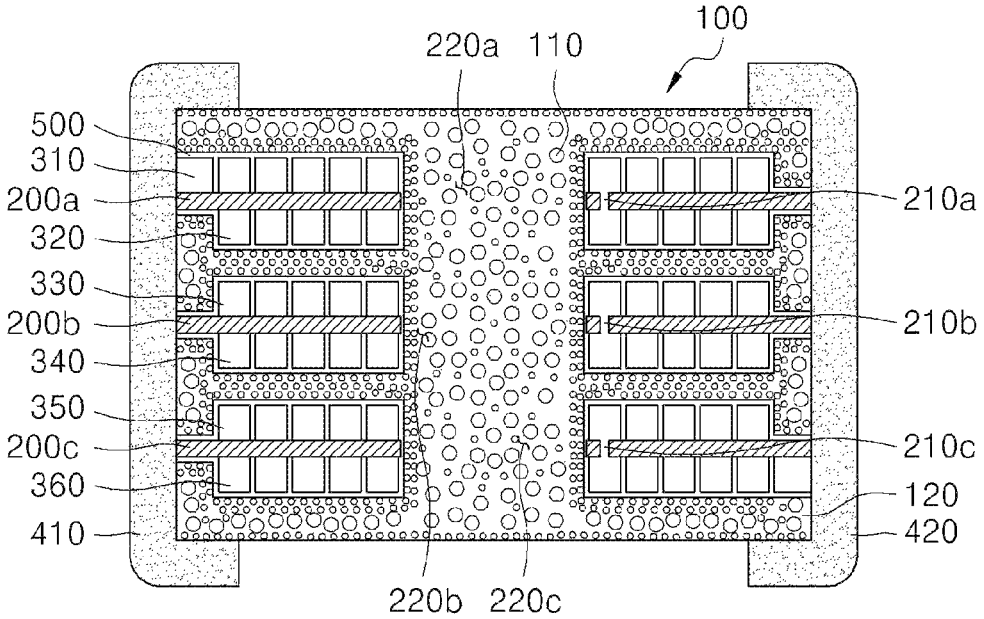
FIGS. 25 and 26 are cross-sectional views taken along lines A-A' and B-B' of FIG. 17 in accordance with a modified example of further another exemplary embodiment.

FIG. 23 is a perspective view of a power inductor in accordance with further another exemplary embodiment, FIG. 24 is a cross-sectional view taken along line A-A' of FIG. 23, and FIG. 25 is a cross-sectional view taken along line B-B' of FIG. 23.

Referring to FIGS. 23 to 25, a power inductor in accordance with further another exemplary embodiment may include a body 100, at least two bases 200*a* and 200*b* (200) provided in the body 100, coil patterns 310, 320, 330, and 340 (300) disposed on at least one surface of each of the at least two bases 200, external electrodes 410 and 420 disposed outside the body 100, an insulation layer 500 disposed on the coil patterns 500, and connection electrodes 710 and 720 (700) spaced apart from the external electrodes 410 and 420 outside the body 100 and connected to at least one coil pattern 300 disposed on each of at least two boards 300 within the body 100. Hereinafter, descriptions duplicated with those in accordance with the foregoing embodiments will be omitted.

The at least two bases 200 (200*a* and 200*b*) may be provided in the body 100 and spaced a predetermined distance from each other a short axial direction of the body 100. That is, the at least two bases 200 may be spaced a predetermined distance from each other in a direction perpendicular to the external electrode 400, i.e., in a thickness direction of the body 100. Also, conductive vias 210 (210*a* and 210*b*) may be formed in the at least two bases 200, respectively. Here, at least a portion of each of the at least two bases 200 may be removed to form each of through-holes 220 (220*a* and 220*b*). Here, the through-holes 220*a* and 220*b* may be formed in the same position, and the conductive vias 210*a* and 210*b* may be formed in the same position or positions different from each other. Of course, an area of the at least two bases 200, in which the through-hole 220 and the coil pattern 300 are not provided, may be removed, and then, the body 100 may be filled. The body 100 may be disposed between the at least two bases 200. The body 100 may be disposed between the at least two bases 200 to improve magnetic permeability of the power inductor. Of course, since the insulation layer 500 is disposed on the coil pattern 300 disposed on the at least two bases 200, the body 100 may not be provided between the bases 200. In this case, the power inductor may be reduced in thickness.

The coil patterns 300 (310, 320, 330, and 340) may be disposed on at least one surface of each of the at least two bases 200, preferably, both surfaces of each of the at least two bases 200. Here, the coil patterns 310 and 320 may be disposed on lower and upper portions of a first substrate 200*a* and electrically connected to each other by the conductive via 210*a* provided in the first base 200*a*. Similarly, the coil patterns 330 and 340 may be disposed on lower and upper portions of a second substrate 200*b* and electrically connected to each other by the conductive via 210*b* provided in the second base 200*b*. Each of the plurality of coil patterns 300 may be formed in a spiral shape on a predetermined area of the base 200, e.g., outward from the through-holes 220*a* and 220*b* in a central portion of the base 200. The two coil patterns 310 and 320 disposed on the base 200 may be connected to each other to form one coil. That is, at least two coils may be provided in one body 100. Here, the upper coil patterns 310 and 330 and the lower coil patterns 320 and 340 of the base 200 may have the same shape. Also, the plurality of coil patterns 300 may overlap each other. Alternatively, the lower coil patterns 320 and 340 may be disposed to overlap an area on which the upper coil patterns 310 and 330 are not disposed.

The external electrodes 400 (410 and 420) may be disposed on both ends of the body 100. For example, the external electrodes 400 may be disposed on two side surfaces of the body 100, which face each other in a longitudinal direction. The external electrode 400 may be electrically connected to the coil patterns 300 of the body 100. That is, at least one end of each of the plurality of coil patterns 300 may be exposed to the outside of the body 100, and the external electrode 400 may be connected to the end of each of the plurality of coil patterns 300. For example, the external electrode 410 may be connected to the coil pattern 310, and the external pattern 420 may be connected to the coil pattern 340. That is, the external electrode 400 may be connected to each of the coil patterns 310 and 340 disposed on the bases 200*a* and 200*b*.

The connection electrode 700 may be disposed on at least one side surface of the body 100, on which the external electrode 400 is not provided. The connection electrode 700 may be disposed on at least one side surface of the body 100, on which the external electrode 400 is not provided. The connection electrode 700 may be disposed on at least one side surface of the body 100, on which the external electrode 400 is not provided. The connection electrode 700 may be provided to connect at least one of the coil patterns 310 and 320 disposed on the first base 200*a* to at least one of the coil patterns 330 and 340 disposed on the second base 200*b*. That is, the connection electrode 710 may connect the coil pattern 320 disposed below the first base 200*a* to the coil pattern 330 disposed above the second base 200*b* at the outside of the body 100. That is, the external electrode 410 may be connected to the coil pattern 310, the connection electrode 710 may connect the coil patterns 320 and 330 to each other, and the external electrode 420 may be connected to the coil pattern 340. Thus, the coil patterns 310, 320, 330, and 340 disposed on the first and second bases 200*a* and 200*b* may be connected to each other in series. Although the connection electrode 710 connects the coil patterns 320 and 330 to each other, the connection electrode 720 may not be connected to the coil patterns 300. This is done because, for convenience of processes, two connection electrodes 710 and 720 are provided, and only one connection electrode 710 is connected to the coil patterns 320 and 330. The connection electrode 700 may be formed by immersing the body 100 into conductive paste or formed on one side surface of the body 100 through various methods such as printing, deposition, and sputtering. The connection electrode 700 may include a metal have electrical conductivity, e.g., at least one metal selected from the group consisting of gold, silver, platinum, copper, nickel, palladium, and an alloy thereof. Here, a nickel-plated layer (not show) and a tin-plated layer (not shown) may be further disposed on a surface of the connection electrode 700.

Figure 26:
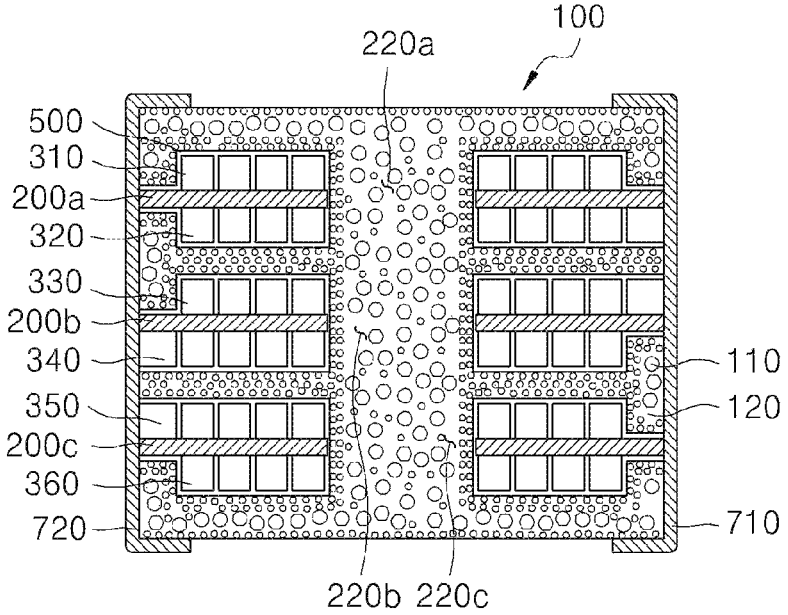
Figure 27:
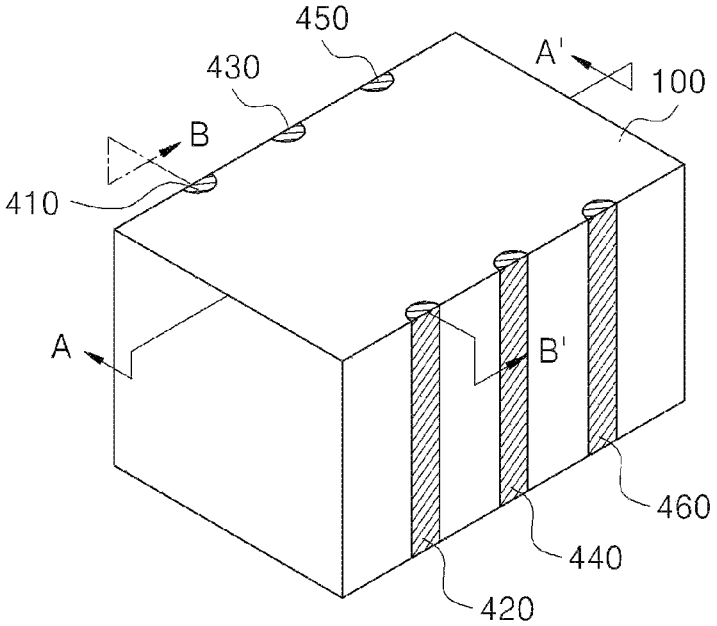
FIG. 27 is a perspective view of the power inductor in accordance with further another exemplary embodiment.

FIGS. 26 to 27 are cross-sectional views illustrating a modified example of a power inductor in accordance with further another exemplary embodiment. That is, three bases 200 (200*a*, 200*b*, and 200*c*) may be provided in the body 100, coil patterns 300 (310, 320, 330, 340, 350, and 360) may be disposed on one surface and the other surface of each of the bases 200, the coil patterns 310 and 360 may be connected to external electrodes 410 and 420, and coil patterns 320 and 330 may be connected to a connection electrode 710, and the coil patterns 340 and 350 may be connected to a connection electrode 720. Thus, the coil patterns 300 respectively disposed on the three bases 200*a*, 200*b*, and 200*c* may be connected to each other in series by the connection electrodes 710 and 720.

As described above, in the power inductors in accordance with further another exemplary embodiment and modified examples, the at least two bases 200 on which each of the coil patterns 300 is disposed on at least one surface may be spaced apart from each other within the body 100, and the coil pattern 300 disposed on the other base 200 may be connected by the connection electrode 700 outside the body 100. As a result, the plurality of coil patterns may be provided within one body 100, and thus, the power inductor may increase in capacity. That is, the coil patterns 300 respectively disposed on the bases 200 different from each other may be connected to each other in series by using the connection electrode 700 outside the body 100, and thus, the power inductor may increase in capacity on the same area.

Figure 28:
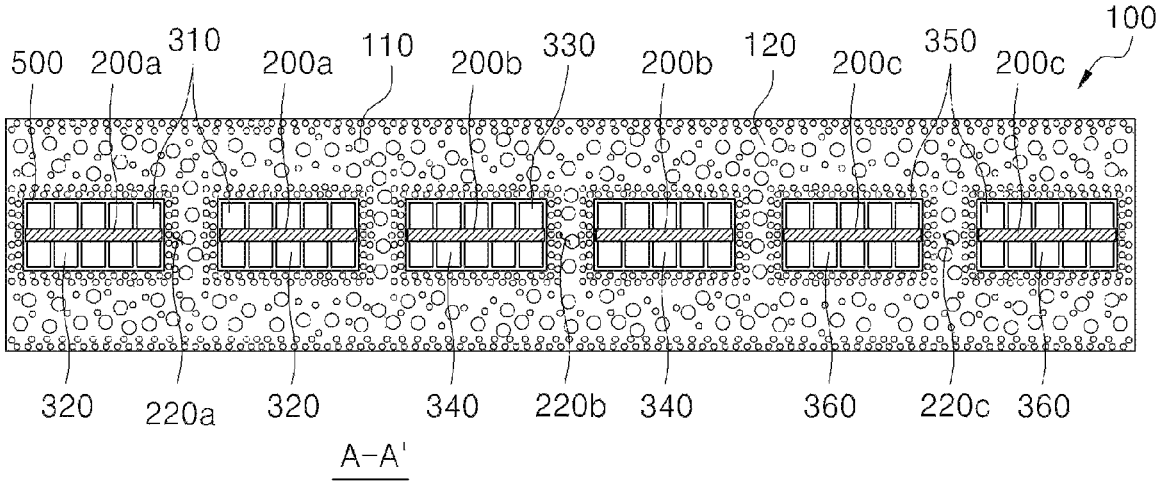
FIGS. 28 and 29 are cross-sectional views taken along lines A-A' and B-B' of FIG. 27.
Figure 29:
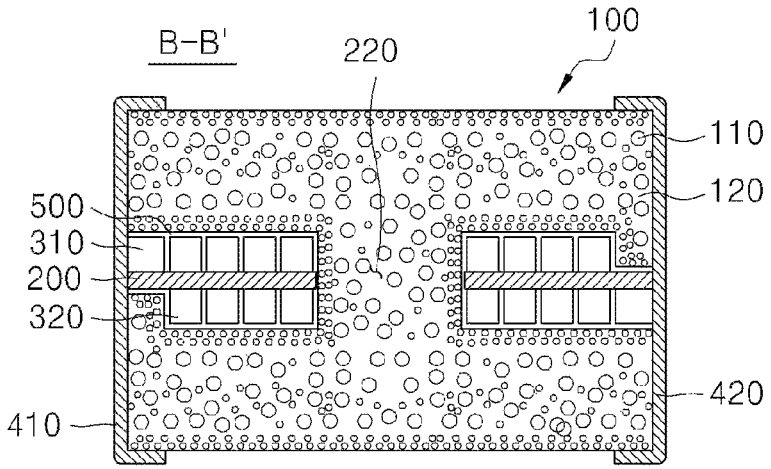
Figure 30:
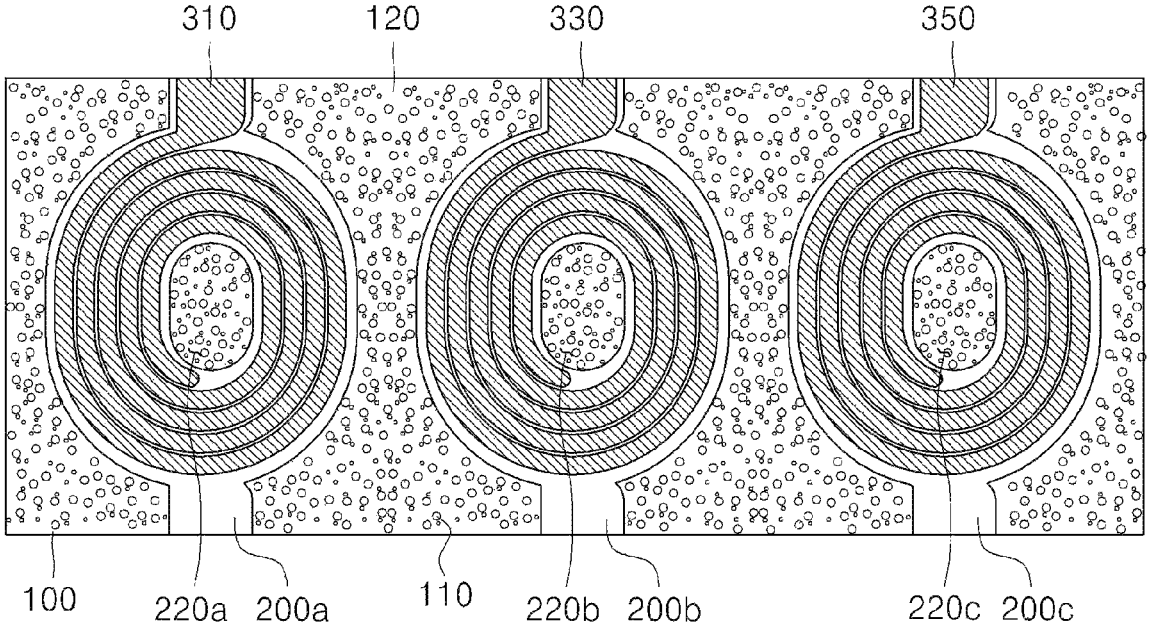
FIG. 30 is an internal plan view of FIG. 27.
Figure 31:
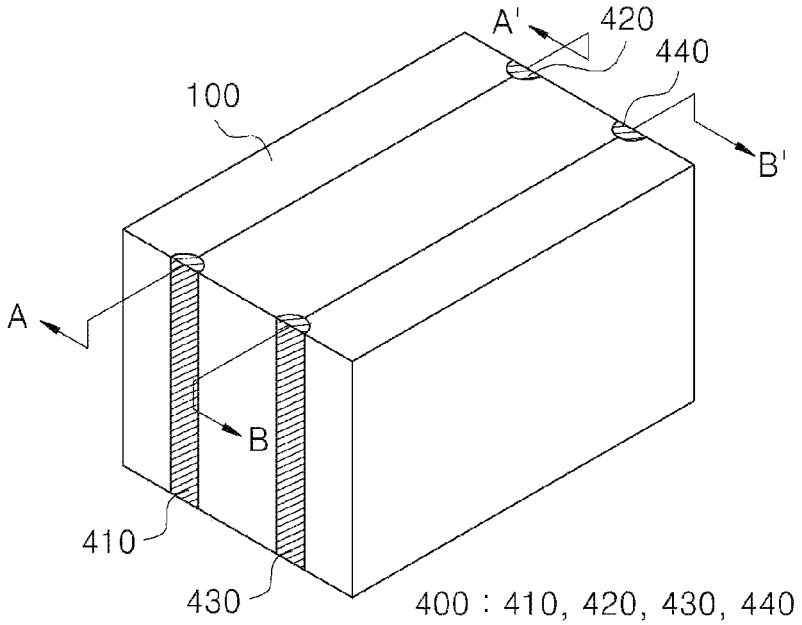
FIG. 31 is a perspective view of a power inductor in accordance with still another exemplary embodiment.

FIG. 28 is a perspective view of a power inductor in accordance with still another exemplary embodiment, and FIGS. 29 and 30 are cross-sectional views taken along lines A-A' and B-B' of FIG. 28. Also, FIG. 31 is an internal plan view.

Referring to FIGS. 28 to 31, a power inductor according to the fourth embodiment of the present invention may include a body 100, at least two bases 200 (200*a*, 200*b*, and 200*c*) provided in the body 100 in a horizontal direction, coil patterns 300 (310, 320, 330, 340, 350, and 360) disposed on at least one surface of each of the at least two bases 200, external electrodes 400 (410, 420, 430, 440, 450, and 460) disposed outside the body 100 and disposed on the at least two bases 200*a*, 200*b*, and 200*c*, and an insulation layer 500 disposed on the coil patterns 300. Hereinafter, descriptions duplicated with the foregoing embodiments will be omitted.

At least two, e.g., three bases 200 (200*a*, 200*b*, and 200*c*) may be provided in the body 100. Here, the at least two bases 200 may be spaced a predetermined distance from each other in a long axis direction that is perpendicular to a thickness direction of the body 100. That is, in further another exemplary embodiment and the modified example, the plurality of bases 200 are arranged in the thickness direction of the body 100, e.g., in a vertical direction. However, in still another exemplary embodiment, the plurality of bases 200 may be arranged in a direction perpendicular to the thickness direction of the body 100, e.g., a horizontal direction. Also, conductive vias 210 (210*a*, 210*b*, and 210*c*) may be formed in the plurality of bases 200, respectively. Here, at least a portion of each of the plurality of bases 200 may be removed to form each of through holes 220 (220*a*, 220*b*, and 220*c*). Of course, an area of the plurality of bases 200, in which the through-holes 220 and the coil patterns 300 are not provided, may be removed as illustrated in FIG. 23, and then, the body 100 may be filled.

The coil patterns 300 (310, 320, 330, 340, 350, and 360) may be disposed on at least one surface of each of the plurality of bases 200, preferably, both surfaces of each of the plurality of bases 200. Here, the coil patterns 310 and 320 may be disposed on one surface and the other surface of a first substrate 200*a* and electrically connected to each other by the conductive via 210*a* provided in the first base 200*a*. Also, the coil patterns 330 and 340 may be disposed on one surface and the other surface of a second substrate 200*b* and electrically connected to each other by the conductive via 210*b* provided in the second base 200*b*. Similarly, the coil patterns 350 and 360 may be disposed on one surface and the other surface of a third substrate 200*c* and electrically connected to each other by the conductive via 210*c* provided in the third base 200*c*. Each of the plurality of coil patterns 300 may be formed in a spiral shape on a predetermined area of the base 200, e.g., outward from the through holes 220*a*, 220*b*, and 200*c* in a central portion of the base 200. The two coil patterns 310 and 320 disposed on the base 200 may be connected to each other to form one coil. That is, at least two coils may be provided in one body 100. Here, the coil patterns 310, 330, and 350 that are disposed on one side of the base 200 and the coil patterns 320, 340, and 360 that are disposed on the other side of the base 200 may have the same shape. Also, the coil patterns 300 may overlap each other on the same base 200. Alternatively, the coil patterns 320, 330, and 350 that are disposed on the one side of the base 200 may be disposed to overlap an area on which the coil patterns 320, 340, and 360 that are disposed on the other side of the base 200 are not disposed.

The external electrodes 400 (410, 420, 430, 440, 450, and 460) may be spaced apart from each other on both ends of the body 100. The external electrode 400 may be electrically connected to the coil patterns 300 respectively disposed on the plurality of bases 200. For example, the external electrodes 410 and 420 may be respectively connected to the coil patterns 310 and 320, the external electrode 430 and 440 may be respectively connected to the coil patterns 330 and 340, and the external electrodes 450 and 460 may be respectively connected to the coil patterns 350 and 360. That is, the external electrodes 400 may be respectively connected to the coil patterns 300 and 340 disposed on the bases 200*a*, 200*b*, and 200*c*.

As described above, in the power inductor according to the fourth embodiment of the present invention, the plurality of inductors may be realized in one body 100. That is, the at least two bases 200 may be arranged in the horizontal direction, and the coil patterns 300 respectively disposed on the bases 200 may be connected to each other by the external electrodes different from each other. Thus, the plurality of inductors may be disposed in parallel, and at least two power inductors may be provided in one body 100.

Figure 32:
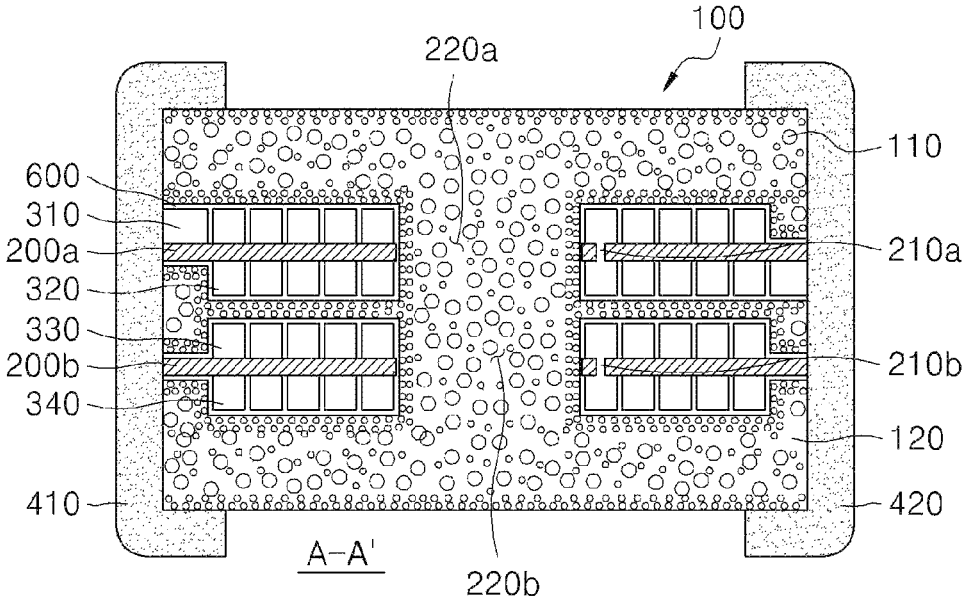
FIGS. 32 and 33 are cross-sectional views taken along lines A-A' and B-B' of FIG. 31, respectively.
Figure 33:
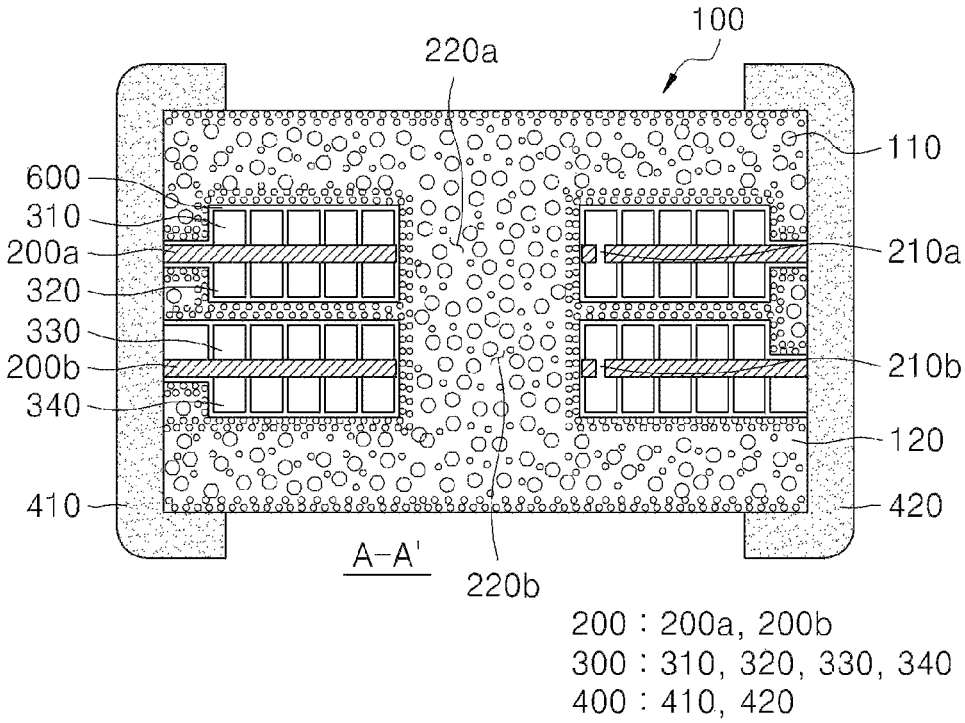

FIG. 32 is a perspective view of a power inductor in accordance with yet another exemplary embodiment, and FIGS. 33 and 34 are cross-sectional views taken along lines A-A' and B-B' of FIG. 32.

Referring to FIGS. 32 to 34, a power inductor in accordance with yet another exemplary embodiment may include a body 100, at least two bases 200 (200*a* and 200*b*) provided in the body 100, coil patterns 300 (310, 320, 330, and 340) disposed on at least one surface of each of the at least two bases 200, and a plurality of external electrodes 400 (410, 420, 430, and 440) disposed on two side surfaces facing of the body 100 and respectively connected to the coil patterns 310, 320, 330, and 340 disposed on the bases 200*a* and 200*b*. Here, the at least two bases 200 may be spaced a predetermined distance from each other and laminated in a thickness direction of the body 100, i.e., in a vertical direction, and the coil patterns 300 disposed on the bases 200 may be withdrawn in directions different from each other and respectively connected to the external electrodes. That is, in still another exemplary embodiment, the plurality of bases 200 may be arranged in the horizontal direction. However, in yet another exemplary embodiment, the plurality of bases may be arranged in the vertical direction. Thus, in yet another exemplary embodiment, the at least two bases 200 may be arranged in the thickness direction of the body 100, and the coil patterns 300 respectively disposed on the bases 200 may be connected to each other by the external electrodes different from each other, and thus, the plurality of inductors may be disposed in parallel, and at least two power inductors may be provided in one body 100.

As described above, in the foregoing embodiments, which are described with reference to FIGS. 23 to 34, the plurality of bases 200, on which the coil patterns 300 disposed on the at least one surface within the body 10 are disposed, may be laminated in the thickness direction (i.e., the vertical direction) of the body 100 or arranged in the direction perpendicular to (i.e., the horizontal direction) the body 100. Also, the coil patterns 300 respectively disposed on the plurality of bases 200 may be connected to the external electrodes 400 in series or parallel. That is, the coil patterns 300 respectively disposed on the plurality of bases 200 may be connected to the external electrodes 400 different from each other and arranged in parallel, and the coil patterns 300 respectively disposed on the plurality of bases 200 may be connected to the same external electrode 400 and arranged in series. When the coil patterns 300 are connected in series, the coil patterns 300 respectively disposed on the bases 200 may be connected to the connection electrodes 700 outside the body 100. Thus, when the coil patterns 300 are connected in parallel, two external electrodes 400 may be required for the plurality of bases 200. When the coil patterns 300 are connected in series, two external electrodes 400 and at least one connection electrode 700 may be required regardless of the number of bases 200. For example, when the coil patterns 300 disposed on the three bases 300 are connected to the external electrodes in parallel, six external electrodes 400 may be required. When the coil patterns 300 disposed on the three bases 300 are connected in series, two external electrodes 400 and at least one connection electrode 700 may be required. Also, when the coil patterns 300 are connected in parallel, a plurality of coils may be provided within the body 100. When the coil patterns 300 are connected in series, one coil may be provided within the body 100.

The present invention may, however, be embodied in different forms and should not be construed as limited to the embodiments set forth herein. Rather, these embodiments are provided so that this disclosure will be thorough and complete, and will fully convey the scope of the present invention to those skilled in the art. Further, the present invention is only defined by scopes of claims.

The invention claimed is:

1. A power inductor comprising:

a body comprising magnetic powder and a polymer;

at least one base provided in the body and having at least one surface on which at least one coil pattern is disposed; and an insulation layer disposed on the base and between the coil pattern and the body, wherein the magnetic powder comprises at least three magnetic powders having different mean values of particle sizes or different middle values of grain-size distribution from one another, wherein a through-hole extends through a central region of the base, and wherein the coil pattern does not overlap the through-hole, wherein the body comprises a first thickness region contacting the insulation layer and includes a magnetic powder of the at least three magnetic powders having a smallest of the mean values of the particle sizes or a smallest of the middle values of the grain-size distribution, wherein the magnetic powder of the at least three magnetic powders having the smallest of the mean values of the particle sizes or the smallest of the middle values of the grain-size distribution contacts the insulation layer and is distributed in a peripheral region of the through-hole, and wherein a magnetic powder of the at least three magnetic powders having a mean value of particle sizes greater than that of the smallest of the mean values of the particle sizes or a middle value of grain-size distribution greater than that of the smallest of the middle values of the grain-size distribution is distributed in a central region of the through-hole that is outside the peripheral region of the through-hole.

2. The power inductor of claim 1, wherein the at least three magnetic powders comprise:

a first magnetic powder, a second magnetic powder having a mean value of particle sizes or a middle value of grain-size distribution less than that of the first magnetic powder, and a third magnetic powder having a mean value of particle sizes or a middle value of grain-size distribution less than that of the second magnetic powder, and wherein the third magnetic powder is the smallest magnetic powder of the at least three magnetic powders.

3. The power inductor of claim 2, wherein the body comprises a second thickness region which is defined inward from at least one of top and bottom surfaces of the base in a vertical direction and comprises the third magnetic powder.

4. The power inductor of claim 3, wherein the body has a remaining region comprising the first to third magnetic powders.

5. The power inductor of claim 2, wherein at least one of the first to third magnetic powders further comprises at least one magnetic powder having a different middle value of the grain-size distribution.

6. The power inductor of claim 2, wherein the at least three magnetic powders further comprise a fourth magnetic powder having a composition different from that of each of the first to third magnetic powders.

7. The power inductor of claim 6, wherein at least one of the first to fourth magnetic powders is crystalline.

8. The power inductor of claim 3, wherein in the body, the second thickness region has a polymer content greater than that of the first thickness region.

9. The power inductor of claim 1, further comprising a capping insulation layer disposed on at least one surface of the body.

10. The power inductor of claim 1, wherein the body has a plurality of surfaces, wherein at least one first surface of the plurality of surfaces has a specific resistance different from that of a second surface of the plurality of surfaces.

11. The power inductor of claim 10, wherein a surface of a side of the body, which is mounted on a printed circuit board, has specific resistance that is greater than that of the second surface.

* * * * *